US006568625B2

(12) United States Patent
Faulks et al.

(10) Patent No.: US 6,568,625 B2
(45) Date of Patent: May 27, 2003

(54) WET WIPES DISPENSER AND MOUNTING SYSTEM

(75) Inventors: Michael John Faulks, Neenah, WI (US); Larry Robert Bohnsack, Grand Chute, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/916,825

(22) Filed: Jul. 27, 2001

(65) Prior Publication Data

US 2003/0019974 A1 Jan. 30, 2003

(51) Int. Cl.[7] ..... B65H 75/18
(52) U.S. Cl. ..... 242/596; 242/596.8
(58) Field of Search ..... 242/594.1, 596, 242/596.1, 596.3, 596.4, 596.7, 596.8, 590, 560, 560.2, 598, 598.3, 598.5, 599.2, 599.3; D6/520, 521, 522, 523

(56) References Cited

U.S. PATENT DOCUMENTS

| | | | |
|---|---|---|---|
| 1,664,392 | A | 4/1928 | Baruch |
| 2,440,974 | A | 5/1948 | Resch |
| 3,310,353 | A | 3/1967 | Cordis |
| 3,368,522 | A | 2/1968 | Cordis |
| 3,532,210 | A | 10/1970 | Minion et al. |
| 3,568,635 | A | 3/1971 | Poitras et al. |
| 3,592,161 | A | 7/1971 | Hoffmann |
| 3,603,519 | A | 9/1971 | Brown |
| 3,633,838 | A | 1/1972 | Krueger |
| 3,656,699 | A | 4/1972 | Schnyder et al. |
| 3,713,170 | A | 1/1973 | Kaufman |
| 3,729,145 | A | 4/1973 | Koo et al. |
| 3,754,804 | A | 8/1973 | Cushman |
| 3,756,483 | A | 9/1973 | Schraeder |
| 3,771,739 | A | 11/1973 | Nelson |
| 3,775,801 | A | 12/1973 | Walker |
| 3,780,908 | A | 12/1973 | Fitzpatrick et al. |
| 3,784,055 | A | 1/1974 | Anderson |
| 3,788,573 | A | 1/1974 | Thomson et al. |
| 3,795,355 | A | 3/1974 | Gerstein |

(List continued on next page.)

FOREIGN PATENT DOCUMENTS

| | | |
|---|---|---|
| EP | 0 122 809 A1 | 10/1984 |

(List continued on next page.)

OTHER PUBLICATIONS

Search Report for Patent Cooperation Treaty application No. PCT/US01/27698, Date of Mailing Apr. 5, 2002, 4 pages.
Invitation to Pay Additional Fees for Patent Cooperation Treaty application No. PCT/US 01/27698, Date of Mailing Jan. 10, 2002, 7 pages.
Search Report for Patent Cooperation Treaty application No. PCT/US 01/28520, Date of Mailing Mar. 4, 2002, 7 pages.
Derwent World Patent Database abstract of DE 3133237: Description of M. Scheepe, "Refill Pack of Moisture–Impregnated Tissues."

(List continued on next page.)

*Primary Examiner*—William A. Rivera
(74) *Attorney, Agent, or Firm*—Brinks Hofer Gilson & Lione

(57) ABSTRACT

There is provided a mounting system for an apparatus for dispensing wet wipes. The system may include a dispenser and a mounting bracket. The dispenser has the ability to be mounted to a conventional toilet tissue holder. The mounting bracket may securely yet removably hold the dispensing apparatus to the holder.

23 Claims, 19 Drawing Sheets

U.S. PATENT DOCUMENTS

| | | | |
|---|---|---|---|
| 3,806,055 | A | 4/1974 | Bauman |
| 3,824,953 | A | 7/1974 | Boone |
| 3,836,044 | A | 9/1974 | Tilp et al. |
| 3,836,045 | A | 9/1974 | Duhy et al. |
| 3,837,595 | A | 9/1974 | Boone |
| 3,841,466 | A | 10/1974 | Hoffman et al. |
| 3,843,017 | A | 10/1974 | Harrison |
| 3,848,822 | A | 11/1974 | Boone |
| 3,865,271 | A | 2/1975 | Gold |
| 3,890,622 | A | 6/1975 | Alden |
| 3,913,522 | A | 10/1975 | Light |
| 3,943,859 | A | 3/1976 | Boone |
| 3,949,947 | A | 4/1976 | Youngquist et al. |
| 3,967,756 | A | 7/1976 | Barish |
| 3,970,215 | A | 7/1976 | McLaren et al. |
| 3,982,659 | A | 9/1976 | Ross |
| 3,986,479 | A | 10/1976 | Bonk |
| 3,994,417 | A | 11/1976 | Boedecker |
| 3,995,582 | A | 12/1976 | Douglas |
| 4,002,264 | A | 1/1977 | Marchesani |
| 4,004,687 | A | 1/1977 | Boone |
| 4,025,004 | A | 5/1977 | Massey |
| 4,043,519 | A | 8/1977 | Suzuki et al. |
| 4,069,789 | A | 1/1978 | Fukagawa et al. |
| 4,071,200 | A | 1/1978 | Stone |
| 4,098,469 | A | 7/1978 | McCarthy |
| 4,101,026 | A | 7/1978 | Bonk |
| 4,106,433 | A | 8/1978 | Fernando et al. |
| 4,106,616 | A | 8/1978 | Boone |
| 4,106,617 | A | 8/1978 | Boone |
| 4,114,824 | A | 9/1978 | Danielak |
| 4,124,259 | A | 11/1978 | Harris |
| 4,131,195 | A | 12/1978 | Worrell, Sr. |
| 4,135,199 | A | 1/1979 | Kurland et al. |
| 4,135,678 | A | 1/1979 | Williams |
| 4,138,034 | A | 2/1979 | McCarthy |
| 4,179,078 | A | 12/1979 | Mansfield |
| 4,191,317 | A | 3/1980 | Harkins |
| 4,205,802 | A | 6/1980 | Economakis |
| 4,219,129 | A | 8/1980 | Sedwick |
| 4,222,621 | A | 9/1980 | Greenlee et al. |
| 4,235,333 | A | 11/1980 | Boone |
| 4,244,493 | A | 1/1981 | Harrison |
| 4,260,117 | A | 4/1981 | Perrin et al. |
| 4,274,573 | A | 6/1981 | Finkelstein |
| 4,294,389 | A | 10/1981 | Falk et al. |
| 4,328,907 | A | 5/1982 | Beard |
| 4,353,480 | A | 10/1982 | McFadyen |
| 4,363,454 | A | 12/1982 | Mohar |
| 4,375,874 | A | 3/1983 | Leotta et al. |
| 4,383,656 | A | 5/1983 | Campbell |
| 4,401,248 | A | 8/1983 | Helms |
| 4,411,374 | A | 10/1983 | Hotchkiss |
| 4,425,012 | A | 1/1984 | Kley |
| 4,427,159 | A | 1/1984 | Miller et al. |
| 4,428,497 | A | 1/1984 | Julius et al. |
| 4,432,504 | A | 2/1984 | Pace |
| 4,436,221 | A | 3/1984 | Margulies |
| 4,447,015 | A | 5/1984 | Peterson |
| 4,453,634 | A | 6/1984 | Blumenthal |
| 4,463,912 | A | 8/1984 | Grunerud |
| 4,467,974 | A | 8/1984 | Crim |
| 4,526,291 | A | 7/1985 | Margulies |
| 4,535,912 | A | 8/1985 | Bonk |
| 4,550,855 | A | 11/1985 | Harrison |
| 4,564,148 | A | 1/1986 | Wentworth |
| 4,566,606 | A | 1/1986 | Kling |
| 4,570,820 | A | 2/1986 | Murphy |
| 4,601,938 | A | 7/1986 | Deacon et al. |
| 4,607,809 | A | 8/1986 | Sineni et al. |
| 4,648,530 | A | 3/1987 | Granger |
| 4,659,028 | A | 4/1987 | Wren |
| 4,662,576 | A | 5/1987 | Paul |
| 4,662,577 | A | 5/1987 | Lewis |
| 4,667,890 | A | 5/1987 | Gietman, Jr. |
| 4,684,075 | A | 8/1987 | Francis |
| 4,690,345 | A | 9/1987 | Cotey |
| 4,721,264 | A | 1/1988 | Muscarello |
| 4,735,317 | A | 4/1988 | Sussman et al. |
| 4,756,485 | A | 7/1988 | Bastian et al. |
| 4,775,109 | A | 10/1988 | Tegg |
| 4,784,290 | A | 11/1988 | Howard |
| 4,790,490 | A | 12/1988 | Chakravorty |
| 4,807,823 | A | 2/1989 | Wyant |
| 4,826,063 | A | 5/1989 | Ban |
| 4,828,193 | A | 5/1989 | Galbraith |
| 4,830,301 | A | 5/1989 | Miller |
| 4,834,316 | A | 5/1989 | DeLorean |
| 4,836,368 | A | 6/1989 | Cotton |
| 4,836,462 | A | 6/1989 | Bruss |
| 4,846,412 | A | 7/1989 | Morand |
| 4,860,893 | A | 8/1989 | Kaufman |
| D303,890 | S | 10/1989 | Pilot |
| 4,877,133 | A | 10/1989 | Klenter et al. |
| 4,883,197 | A | 11/1989 | Sanchez et al. |
| 4,884,690 | A | 12/1989 | Klenter et al. |
| 4,890,205 | A | 12/1989 | Shaffer |
| 4,913,365 | A | 4/1990 | Shamass |
| 4,936,452 | A | 6/1990 | Pauley |
| D311,106 | S | 10/1990 | Jaber |
| 4,978,095 | A | 12/1990 | Phillips |
| 4,984,530 | A | 1/1991 | Dutton |
| 4,989,800 | A | 2/1991 | Tritch |
| 4,991,538 | A | 2/1991 | Davids et al. |
| 5,000,393 | A | 3/1991 | Madsen |
| 5,009,313 | A | 4/1991 | Morand |
| 5,012,986 | A | 5/1991 | Needle |
| 5,029,787 | A | 7/1991 | Florentin |
| 5,049,440 | A | 9/1991 | Bornhoeft, III et al. |
| 5,050,737 | A | 9/1991 | Joslyn et al. |
| 5,104,054 | A | 4/1992 | Latham |
| 5,137,173 | A | 8/1992 | Hughes et al. |
| 5,141,171 | A | 8/1992 | Yang |
| 5,145,091 | A | 9/1992 | Meyers |
| D329,978 | S | 10/1992 | Ryan |
| 5,154,496 | A | 10/1992 | Campbell et al. |
| 5,170,958 | A | 12/1992 | Brown |
| 5,172,840 | A | 12/1992 | Bloch et al. |
| 5,192,044 | A | 3/1993 | Baskin |
| 5,193,759 | A | 3/1993 | Bigelow et al. |
| 5,195,689 | A | 3/1993 | Beer et al. |
| 5,207,367 | A | 5/1993 | Dunn et al. |
| 5,219,092 | A | 6/1993 | Morand |
| 5,228,632 | A | 7/1993 | Addison et al. |
| 5,253,818 | A | 10/1993 | Craddock |
| 5,255,800 | A | 10/1993 | Kelly |
| D342,635 | S | 12/1993 | Carter et al. |
| D342,852 | S | 1/1994 | Welch |
| 5,277,375 | A | 1/1994 | Dearwester |
| 5,310,262 | A | 5/1994 | Robison et al. |
| 5,311,986 | A | 5/1994 | Putz |
| 5,312,883 | A | 5/1994 | Komatsu et al. |
| 5,317,063 | A | 5/1994 | Komatsu et al. |
| D347,534 | S | 6/1994 | Gottselig |
| 5,335,811 | A | 8/1994 | Morand |
| 5,368,157 | A | 11/1994 | Gasparrini et al. |
| 5,370,336 | A | 12/1994 | Whittington |
| 5,374,008 | A | 12/1994 | Halvorson et al. |
| 5,384,189 | A | 1/1995 | Kuroda et al. |
| 5,392,945 | A | 2/1995 | Syrek |
| 5,400,982 | A | 3/1995 | Collins |

| | | | |
|---|---|---|---|
| 5,409,181 | A | 4/1995 | Patrick |
| 5,439,521 | A | 8/1995 | Rao |
| 5,443,084 | A | 8/1995 | Saleur |
| 5,449,127 | A | 9/1995 | Davis |
| D362,773 | S | 10/1995 | Kartchner |
| 5,456,420 | A | 10/1995 | Frazier |
| 5,456,421 | A | 10/1995 | Reed |
| 5,462,197 | A | 10/1995 | Pound |
| 5,464,096 | A | 11/1995 | Hurwitz |
| 5,464,170 | A | 11/1995 | Mitchell et al. |
| 5,480,060 | A | 1/1996 | Blythe |
| 5,494,250 | A | 2/1996 | Chen |
| 5,495,997 | A | 3/1996 | Moody |
| 5,501,323 | A | 3/1996 | Denesha et al. |
| 5,509,593 | A | 4/1996 | Bloch et al. |
| 5,520,308 | A | 5/1996 | Berg, Jr. et al. |
| 5,526,973 | A | 6/1996 | Boone et al. |
| 5,533,621 | A | 7/1996 | Schoal, Jr. |
| 5,540,332 | A | 7/1996 | Kopacz et al. |
| 5,542,568 | A | 8/1996 | Julius |
| 5,560,514 | A | 10/1996 | Frazier |
| 5,588,615 | A | 12/1996 | Batts |
| D377,284 | S | 1/1997 | Farrow et al. |
| 5,598,987 | A | 2/1997 | Wachowicz |
| 5,604,992 | A | 2/1997 | Robinson |
| 5,605,250 | A | 2/1997 | Meiron et al. |
| 5,609,269 | A | 3/1997 | Behnke et al. |
| 5,618,008 | A | 4/1997 | Dearwester et al. |
| 5,620,148 | A | 4/1997 | Mitchell |
| 5,624,025 | A | 4/1997 | Hixon |
| 5,630,526 | A | 5/1997 | Moody |
| 5,630,563 | A | 5/1997 | Meisner et al. |
| 5,631,317 | A | 5/1997 | Komatsu et al. |
| 5,642,810 | A | 7/1997 | Warner et al. |
| 5,649,676 | A | 7/1997 | Lord |
| D381,851 | S | 8/1997 | Sharpe |
| 5,653,403 | A | 8/1997 | Ritchey |
| 5,655,661 | A | 8/1997 | Rigby |
| 5,660,313 | A | 8/1997 | Newbold |
| 5,660,636 | A | 8/1997 | Shangold et al. |
| 5,667,092 | A | 9/1997 | Julius et al. |
| 5,669,576 | A | 9/1997 | Moody |
| 5,672,206 | A | 9/1997 | Gorman |
| D386,025 | S | 11/1997 | Mervar et al. |
| 5,687,875 | A | 11/1997 | Watts et al. |
| D387,590 | S | 12/1997 | Cameron et al. |
| 5,697,576 | A | 12/1997 | Bloch et al. |
| 5,697,577 | A | 12/1997 | Ogden |
| 5,704,565 | A | 1/1998 | Cheng |
| 5,704,566 | A | 1/1998 | Schutz et al. |
| 5,765,717 | A | 6/1998 | Gottselig |
| D397,265 | S | 8/1998 | Badillo |
| RE35,976 | E | 12/1998 | Gasparrini et al. |
| 5,848,762 | A | 12/1998 | Reinheimer et al. |
| 5,868,275 | A | 2/1999 | Moody |
| 5,868,335 | A | 2/1999 | Lebrun |
| 5,868,344 | A | 2/1999 | Melnick |
| 5,868,345 | A | 2/1999 | Beisser |
| 5,868,346 | A | 2/1999 | Cobos |
| 5,868,347 | A | 2/1999 | Paul et al. |
| 5,875,985 | A | 3/1999 | Cohen et al. |
| 5,887,759 | A | 3/1999 | Ayigbe |
| 5,887,818 | A | 3/1999 | Kelley |
| 5,893,531 | A | 4/1999 | Taylor et al. |
| 5,897,074 | A | 4/1999 | Marino |
| 5,901,921 | A | 5/1999 | Perlsweig |
| 5,904,316 | A | 5/1999 | Dunning et al. |
| 5,914,177 | A | 6/1999 | Smith, III et al. |
| 5,924,617 | A | 7/1999 | LaCount et al. |
| D412,439 | S | 8/1999 | Cormack |
| 5,938,013 | A | 8/1999 | Palumbo et al. |
| 5,950,960 | A | 9/1999 | Marino |
| 5,951,762 | A | 9/1999 | Shangold et al. |
| 5,958,187 | A | 9/1999 | Bhat et al. |
| 5,964,351 | A | 10/1999 | Zander |
| 5,967,452 | A | 10/1999 | Wilder |
| 5,971,138 | A | 10/1999 | Soughan |
| 5,971,142 | A | 10/1999 | Jones |
| D416,794 | S | 11/1999 | Cormack |
| D417,109 | S | 11/1999 | Johnson et al. |
| 5,979,821 | A | 11/1999 | LaCount et al. |
| 5,992,718 | A | 11/1999 | Zaranck |
| D417,987 | S | 12/1999 | Velazquez |
| 6,000,538 | A | 12/1999 | Lee |
| 6,000,658 | A | 12/1999 | McCall, Jr. |
| 6,007,019 | A | 12/1999 | Lynch |
| 6,010,001 | A | 1/2000 | Osborn, III |
| 6,015,125 | A | 1/2000 | Fischer |
| 6,024,216 | A | 2/2000 | Shillington et al. |
| 6,024,217 | A | 2/2000 | Ponse et al. |
| 6,024,323 | A | 2/2000 | Palerno, Jr. |
| D421,691 | S | 3/2000 | Hoblitz |
| 6,036,134 | A | 3/2000 | Moody |
| D422,437 | S | 4/2000 | Conran et al. |
| 6,047,920 | A | 4/2000 | Dearwester et al. |
| 6,056,233 | A | 5/2000 | Von Schenk |
| 6,056,235 | A | 5/2000 | Brozinsky |
| 6,059,882 | A | 5/2000 | Steinhardt et al. |
| 6,059,928 | A | 5/2000 | Van Luu et al. |
| 6,068,118 | A | 5/2000 | Calloway |
| 6,070,821 | A | 6/2000 | Mitchell |
| 6,079,603 | A | 6/2000 | Smegal |
| 6,082,664 | A | 7/2000 | Phelps et al. |
| 6,085,899 | A | 7/2000 | Thorsbakken |
| 6,092,690 | A | 7/2000 | Bitowft et al. |
| 6,092,758 | A | 7/2000 | Gemmell |
| 6,092,759 | A | 7/2000 | Gemmell et al. |
| D429,282 | S | 8/2000 | Valazquez et al. |
| 6,098,836 | A | 8/2000 | Gottselig |
| 6,121,165 | A | 9/2000 | Mackey et al. |
| 6,138,939 | A | 10/2000 | Phelps et al. |
| 6,158,614 | A | 12/2000 | Haines et al. |
| 6,273,359 | B1 * | 8/2001 | Newman et al. ..... 242/594.1 |
| 6,450,439 | B1 * | 9/2002 | van Rees ..... 242/596.4 |

FOREIGN PATENT DOCUMENTS

| | | |
|---|---|---|
| EP | 0 251 103 A1 | 1/1988 |
| EP | 0 501 905 A1 | 9/1992 |
| EP | 0 608 460 A1 | 8/1994 |
| EP | 0 608 460 B1 | 9/1998 |
| EP | 1 023 863 A1 | 8/2000 |
| EP | 1 048 257 A3 | 11/2000 |
| EP | 1 048 257 A2 | 11/2000 |
| GB | 990332 | 4/1965 |
| GB | 1324818 | 7/1973 |
| GB | 1 327 954 | 8/1973 |
| GB | 2 357 076 A | 6/2001 |
| WO | WO 93/17933 | 9/1993 |
| WO | WO 96/21388 A1 | 7/1996 |
| WO | WO 97/24054 | 7/1997 |
| WO | WO 98/08763 A1 | 3/1998 |
| WO | WO 99/06311 A2 | 2/1999 |
| WO | WO 99/01536 A1 | 4/1999 |
| WO | WO 00/00071 | 1/2000 |
| WO | WO 00/08998 | 2/2000 |

OTHER PUBLICATIONS

Derwent World Patent Database abstract of JP 07–284,461 A: Description of Kusunoki N (KUSU–I), "Toilet Paper Holder," and Patent Abstracts of Japan JP 07–284,461: Description of Kusunoki Nobuaki, "Toilet Paper–Holder Allowing Taking Out Paper Thereof With One Hand."

Derwent World Patent Database abstract of JP 00–085,782 A: Description of Pigeon KK (PIGE–N), "Paper Holder For Wet Tissues Used In Toilets," and Patent Abstracts of Japan JP 00–085,782: Description of Watanabe Kuniko et al., "Paper Holder."
Kotler, Philip, *Marketing Management*, Prentice Hall, Upper Saddle River, NJ, 2000, p. 456–483.
PCT search report for application Ser. No.: PCT/US00/11284, dated Jul. 28, 2000.
Images of Moist Mates product—dispenser and wipes, approximately 1996.
Images of Moist Mates product—dispenser, approximately 2000.
Images of Moist Mates product—refill wipes, approximately 2000.
Search Report for Patent Cooperation Treaty application No. PCT/US 01/11195, Date of Mailing Jul. 19, 2001, 7 pages.
Search Report for Patent Cooperation Treaty application No. PCT/US 01/11198, Date of Mailing Jul. 19, 2001, 7 pages.
Search Report for Patent Cooperation Treaty application No. PCT/US 01/11620, Date of Mailing Jul. 19, 2001, 7 pages.
Search Report for Patent Cooperation Treaty application No. PCT/US 01/11686, Date of Mailing Jul. 11, 2001, 5 pages.
Search Report for Patent Cooperation Treaty application No. PCT/US 01/11131, Date of Mailing Jul. 23, 2001, 7 pages.
Search Report for Patent Cooperation Treaty application No. PCT/US 01/11447, Date of Mailing Jul. 19, 2001, 6 pages.
Search Report for Patent Cooperation Treaty application No. PCT/US 01/11467, Date of Mailing Jul. 19, 2001, 7 pages.
Search Report for Patent Cooperation Treaty application No. PCT/US 01/12091, Date of Mailing Jul. 9, 2001, 4 pages.
Search Report for Patent Cooperation Treaty application No. PCT/US 01/14113, Date of Mailing Jul. 19, 2001, 6 pages.
Search Report for Patent Cooperation Treaty application No. PCT/US 01/40677, Date of Mailing Jul. 19, 2001, 6 pages.
Letter, dated Apr. 4, 1998, and accompanying drawings.

* cited by examiner

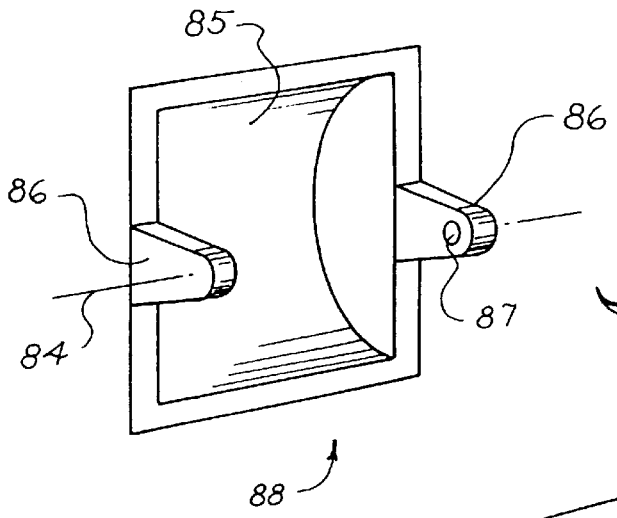
Fig. 1
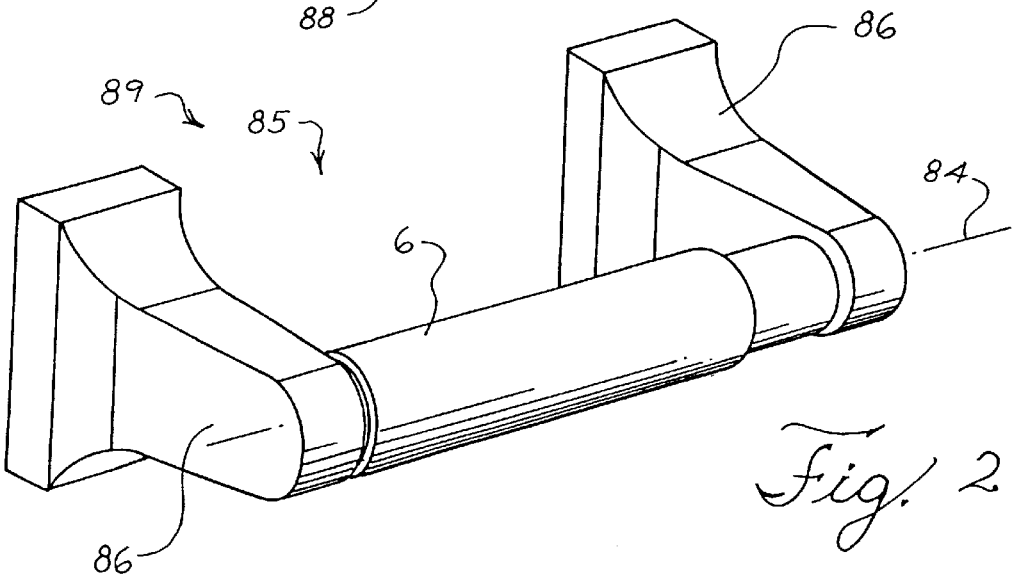
Fig. 2
Fig. 3
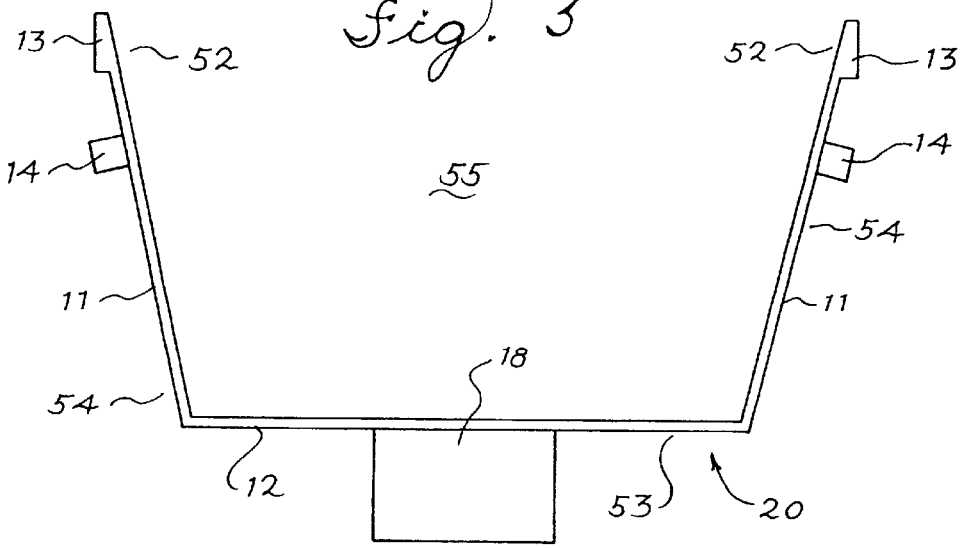

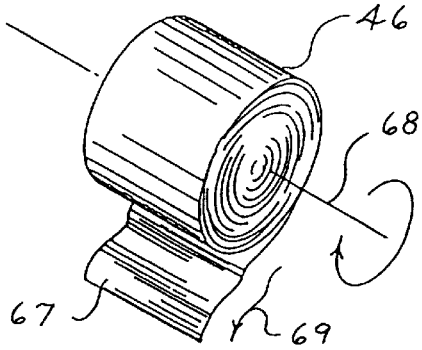
Fig. 21
Fig. 22
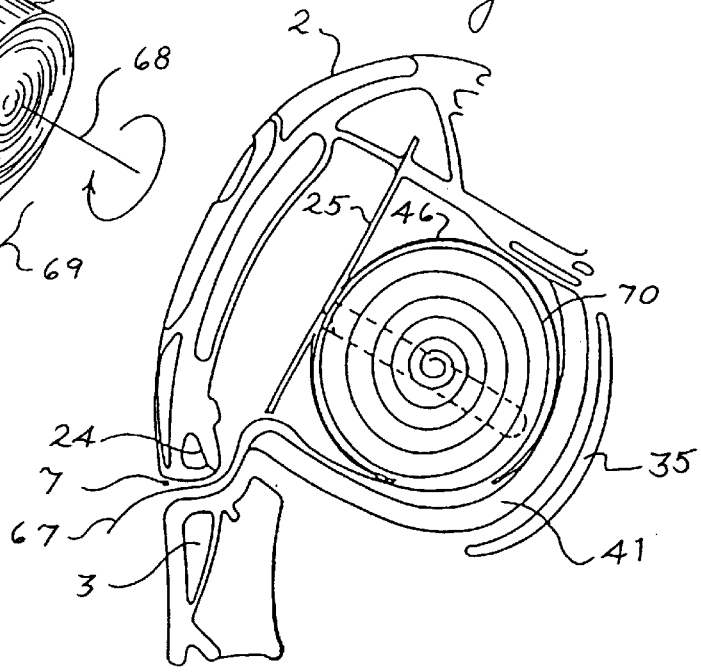
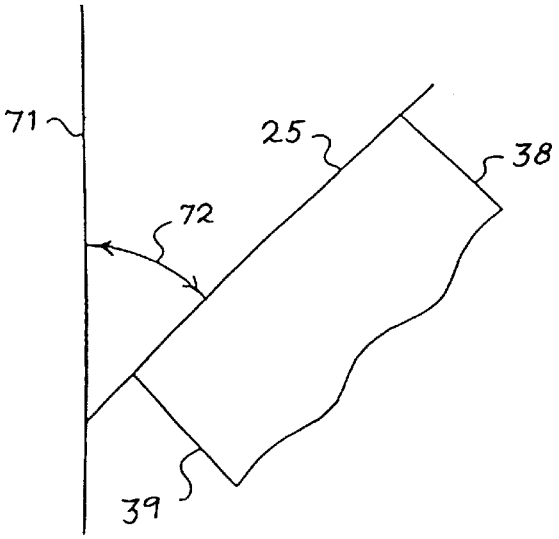
Fig. 23
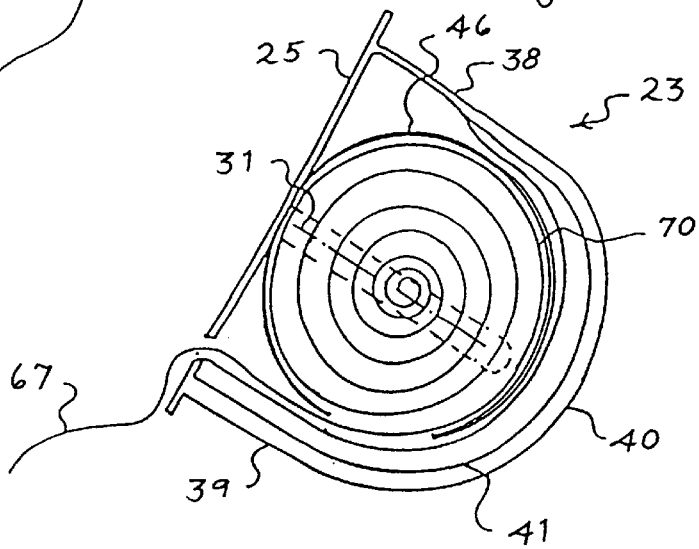
Fig. 24

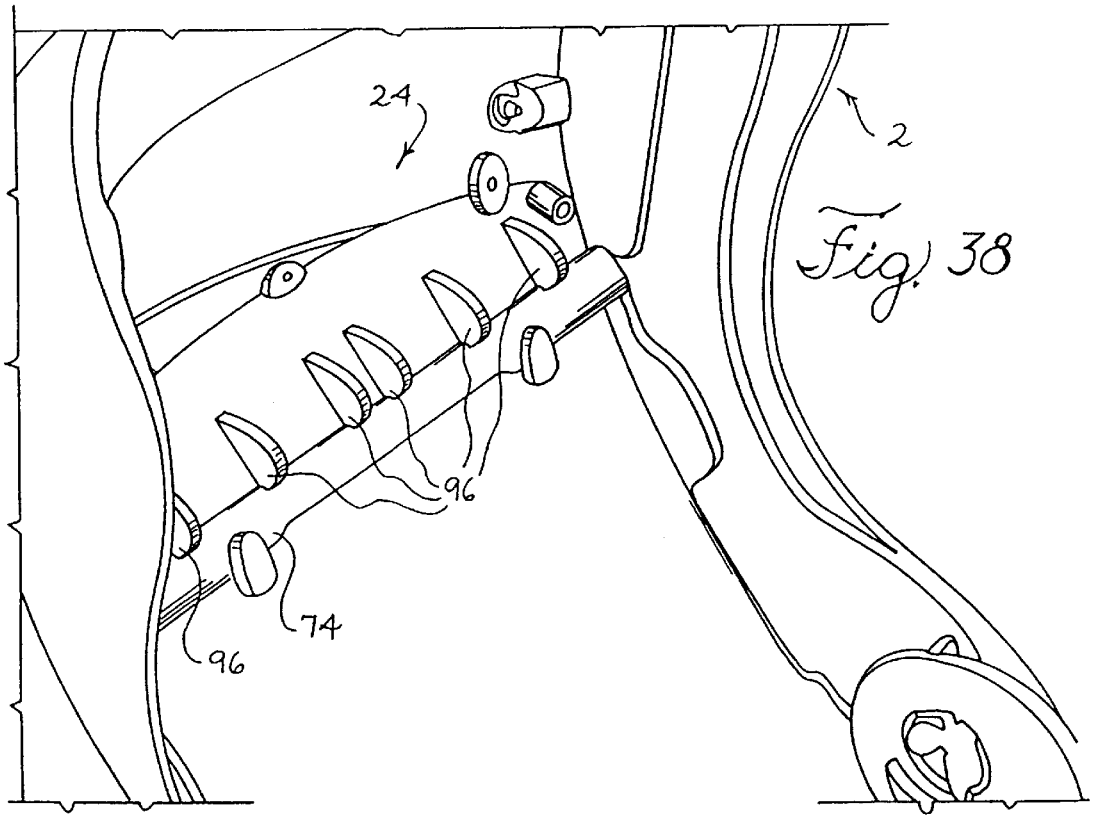
Fig. 38
Fig. 39
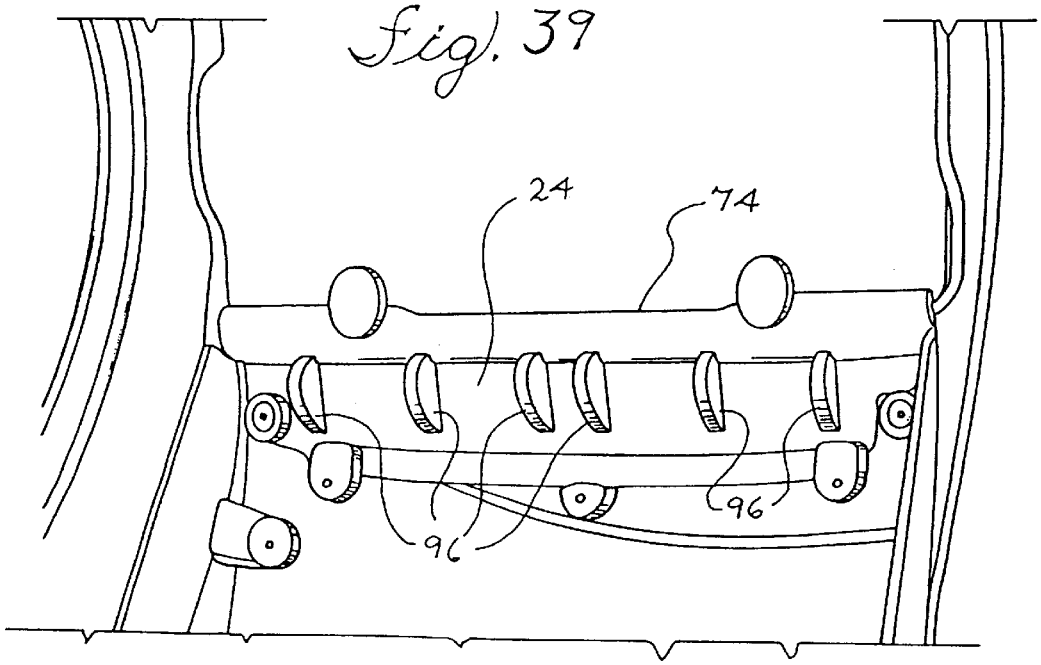

Fig. 41
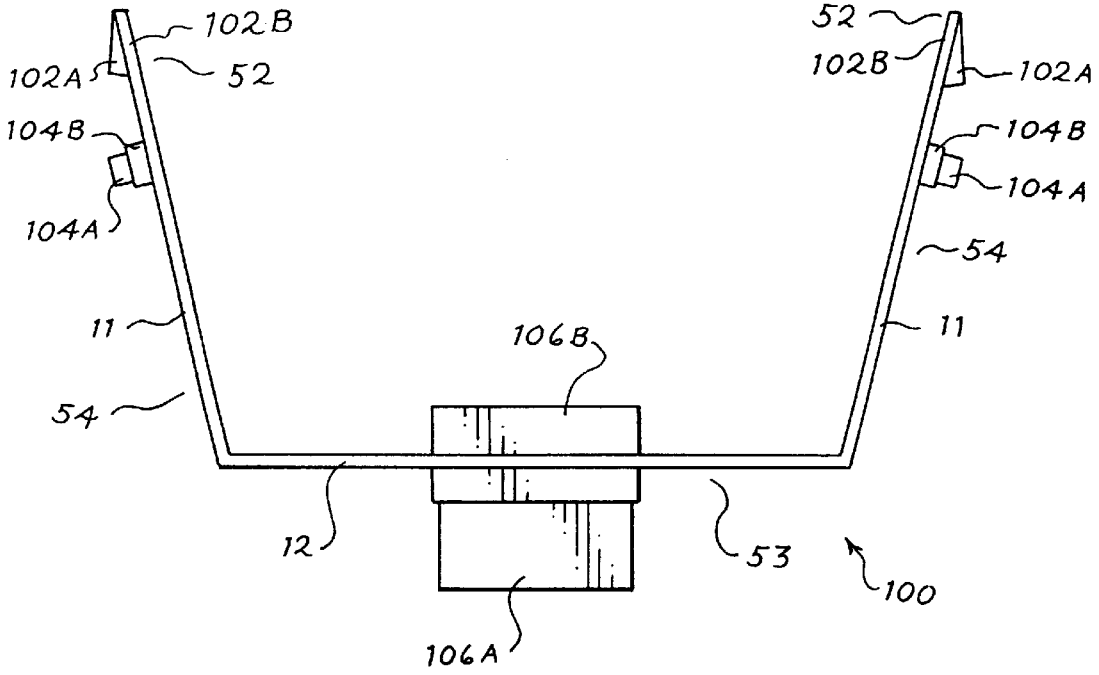
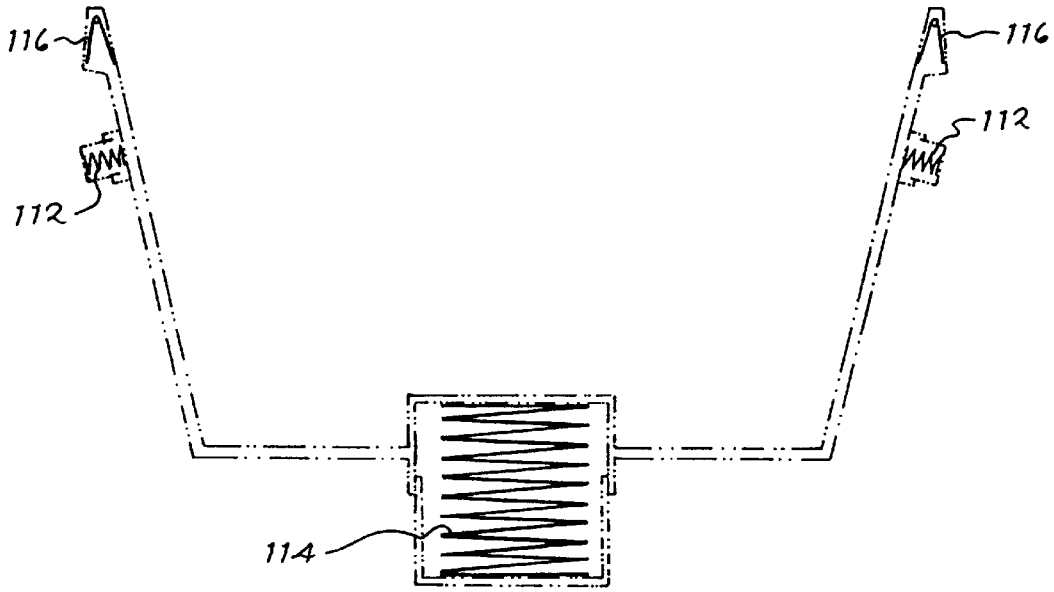
Fig. 42

WET WIPES DISPENSER AND MOUNTING SYSTEM

BACKGROUND OF THE INVENTION

Wet products such as wet wipes have many applications. They may be used with small children and infants when changing diapers, they may be used for household cleaning tasks, they may be used for cleaning hands, they may be used as a bath tissue, they may be used by a caregiver to clean a disabled or incontinent adult, or they may be used in and for a whole host of other applications, where it is advantageous to have a wipe or towel that has some moisture in it.

Wet wipes have been traditionally dispensed in sheet from a tub like container with a hinged lid on the top. The lid is opened and individual or singularized sheets of the wipes are removed. Another type of container that has been used for wet wipes provides a roll of wipes in which the wipes are pulled from the top of the container in a direction that is parallel to the axis of the roll. These wipes are pulled from the center of a hollow coreless roll that has perforated sheets. These containers generally have a snap top lid that is opened to expose a piece of the wipes that can then be pulled to remove the desired amount of wipes. Once pulled out the wipes can then be torn off, usually at a perforation, and the lid closed.

Wet wipes can be any wipe, towel tissue or sheet like product including natural fibers, synthetic fibers, synthetic material and combinations thereof, that is wet or moist or becomes wet during use or prior to use. Examples of wet wipes are disclosed in application Ser. Nos. 09/564,449; 09/564,213; 09/565,125; 09/564,837; 09/564,939; 09/564,531; 09/564,268; 09/564,424; 09/564,780; 09/564,212; 09/565,623 all filed May 4, 2000, and application Ser. No. 09/223,999, filed Dec. 31, 1998, the disclosures of which are incorporated herein by reference. Embodiments of dispensers are described in application Ser. Nos. 09/565,227 and 09/545,995; in application Ser. Nos. 09/659,307; 09/659,295; 09/660,049; 09/659,311; 09/660,040; 09/659,283; 09/659,284; 09/659,306, filed Sep. 12, 2000; in application Ser. No. 09/748,618, filed Dec. 22, 2000; in application Ser. No. 09/841,323, filed Apr. 24, 2001; in application Ser. No. 09/844,731, filed Apr. 27, 2001; and in application Ser. No. 09/849,935, filed May 4, 2001; the disclosures of which are incorporated herein by reference.

There is a need for dispensers for wipes which can be easily mounted to existing toilet tissue holders. It is especially desirable that the dispensers have a size and configuration which allow them to be mounted and used in areas which have physical obstructions, such as an overhanging ledge.

SUMMARY OF THE INVENTION

In an embodiment of the present invention, there is provided a dispensing system for wipes comprising a dispenser, the dispenser comprising a top; and a mounting bracket, the mounting bracket comprising arms and protrusions on the arms; the mounting bracket capable of being connected to the dispenser and to a toilet tissue holder; the toilet tissue holder comprising posts and a horizontal axis defined by the posts; wherein the dispenser can be removably mounted between the posts of the toilet tissue holder by engagement of the protrusions with the posts such that the distance between the horizontal axis and the top of the dispenser is less than 5 inches.

These embodiments may further comprise a system wherein the mounting bracket further comprises tabs at the end of the arms; and the dispenser further comprises sleeves; wherein the tabs and sleeves mate together to connect the mounting bracket and the dispenser. These embodiments may yet further comprise a system wherein the mounting bracket further comprises tabs at the end of the arms; and the dispenser further comprises cavities and bracket guides; wherein the tabs, cavities, and bracket guides mate together to connect the mounting bracket and the dispenser. These embodiments may yet further comprise a system wherein the mounting bracket further comprises a back piece, the back piece connecting the arms, and the back piece further comprising a shim; wherein the toilet tissue holder further comprises a rear periphery, and wherein the shim contacts the rear periphery when the dispenser is mounted; and wherein the distance between the horizontal axis and the top of the dispenser is less than 4 inches, less than 3 inches, and less than 2 inches.

In an embodiment of the invention there is provided a dispensing system for wipes comprising a dispenser; and a mounting bracket attached to the dispenser; the mounting bracket comprising arms, the arms comprising protrusions; and the mounting bracket comprising a back piece, the back piece connecting the arms, and the back piece comprising a shim; wherein the mounting bracket can be removably mounted to a toilet tissue holder comprising posts and a rear periphery by engagement of the protrusions with the posts and by contact of the shim with the rear periphery.

These embodiments may further comprise a system wherein the shim is made of a compression resilient material; wherein the shim is made of foam; wherein the shim is made of a thermoplastic elastomer; and wherein the shim comprises a spring.

In an embodiment of the invention there is provided a dispensing system for wipes comprising a dispenser, the dispenser comprising a means for dispensing wet wipes and a means for receiving a bracket; and a mounting bracket, the mounting bracket comprising a means for engaging a toilet tissue holder comprising posts and a rear periphery, and a means for connecting to the dispenser; wherein the receiving means, connecting means, and engaging means coordinate to secure the dispenser to the toilet tissue holder posts.

These embodiments may further comprise a system wherein the dispensing means is capable of maintaining at least 95% of the moisture of wet wipes for a 14 day period at 73° F. and 50% relative humidity; wherein the receiving means and the connecting means coordinate to attach the dispenser and the mounting bracket; wherein the mounting bracket further comprises a means for contacting the rear periphery; and wherein the receiving means, connecting means, and engaging means further coordinate with the contacting means to secure the dispenser to the toilet tissue holder.

In an embodiment of the invention there is provided a dispensing system for wipes comprising a dispenser; the dispenser comprising a housing, the housing comprising sleeves; and a mounting bracket, the mounting bracket comprising a back piece and arms; the arms comprising a front, a rear, and an exterior; the arms comprising tabs at the front, and protrusions on the exterior; the back piece connecting the arms at the rear of the arms to form an interior; the back piece comprising a shim on the exterior; the tabs mated with the sleeves; and the dispenser positioned adjacent the interior of the mounting bracket; wherein the protrusions and the shim together can engage a toilet tissue holder to secure the dispenser and mounting bracket to the toilet tissue holder.

In an embodiment of the invention there is provided a dispenser for wipes comprising a housing; a cover, the cover pivotally connected to the housing; arms, the arms connected to the housing, the arms comprising protrusions; and a back piece, the back piece connecting the arms, the back piece comprising a shim; wherein the dispenser can be mounted to a toilet tissue holder comprising posts and a rear periphery by engaging the protrusions with the posts and contacting the shim with the rear periphery.

In an embodiment of the invention there is provided a method for dispensing wipes comprising providing a dispenser; the dispenser comprising a housing and a mounting bracket connected to the housing; and the mounting bracket comprising arms and protrusions on the arms; engaging the protrusions with the posts of a toilet tissue holder; placing wipes in the dispenser; and dispensing the wipes.

These embodiments may further comprise a method wherein the bracket further comprises a back piece, the back piece connecting the arms, and the back piece comprising a shim; and may further comprise compressing the shim against the rear periphery of a toilet tissue holder.

In an embodiment of the invention there is provided a method for dispensing wipes comprising: providing a bracket; the bracket comprising a back piece having a shim; the bracket comprising arms connected to the back piece, the arms comprising protrusions and tabs; contacting the shim against the rear periphery of a toilet tissue holder; engaging the protrusions with the posts of a toilet tissue holder; providing a dispenser, the dispenser comprising sleeves; attaching the dispenser to the bracket by mating the sleeves and the tabs; placing wipes in the dispenser; and dispensing the wipes.

DRAWINGS

FIG. 1 is a perspective view of a conventional toilet tissue holder (recessed).

FIG. 2 is a perspective view of a conventional toilet tissue holder.

FIG. 3 is a diagrammatic view of a bracket.

Figure 4A:
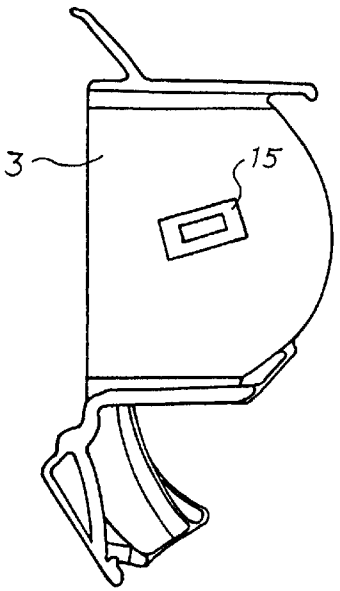
Figure 4B:
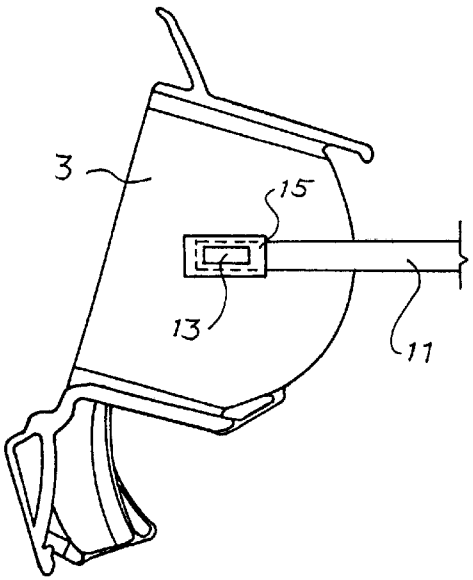

FIGS. 4*a–b* are partial side views of a housing.

Figure 5:
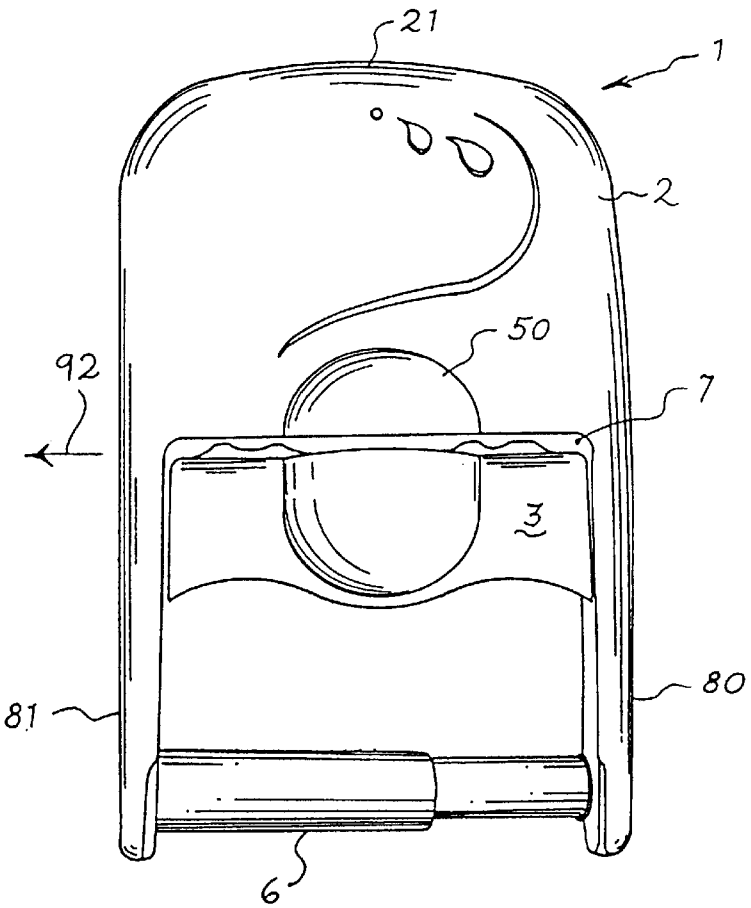

FIG. 5 is a front view of a dispenser.

Figure 6:
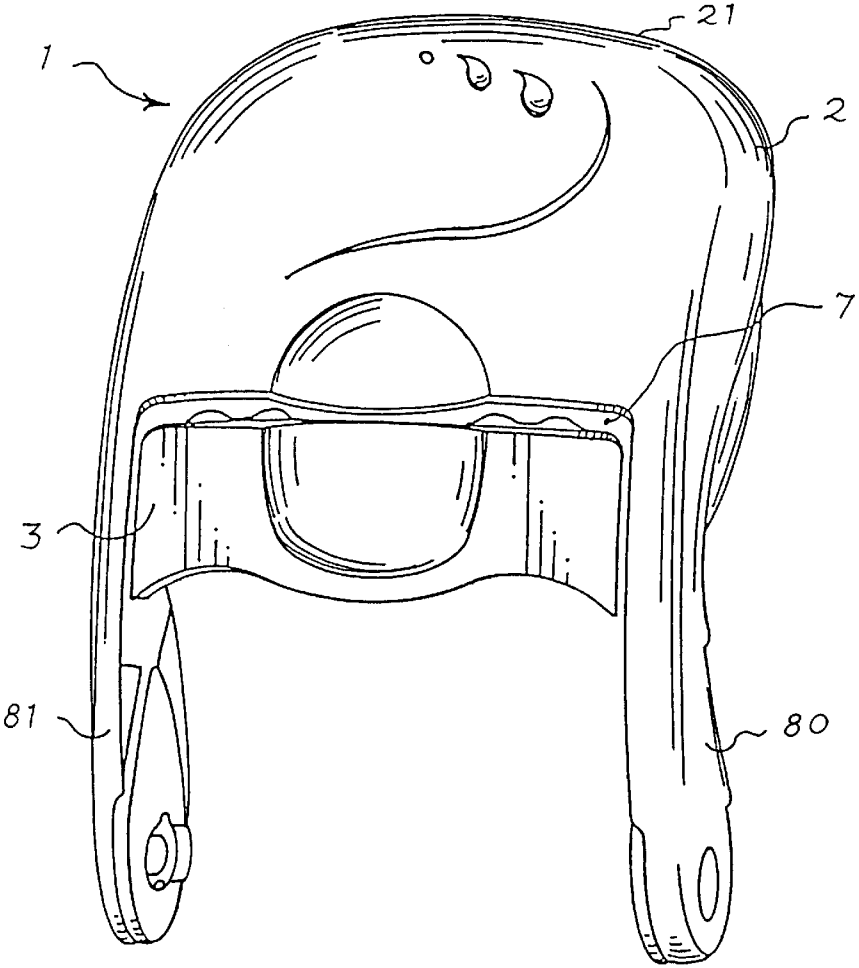

FIG. 6 is a perspective view of a dispenser.

Figure 7:
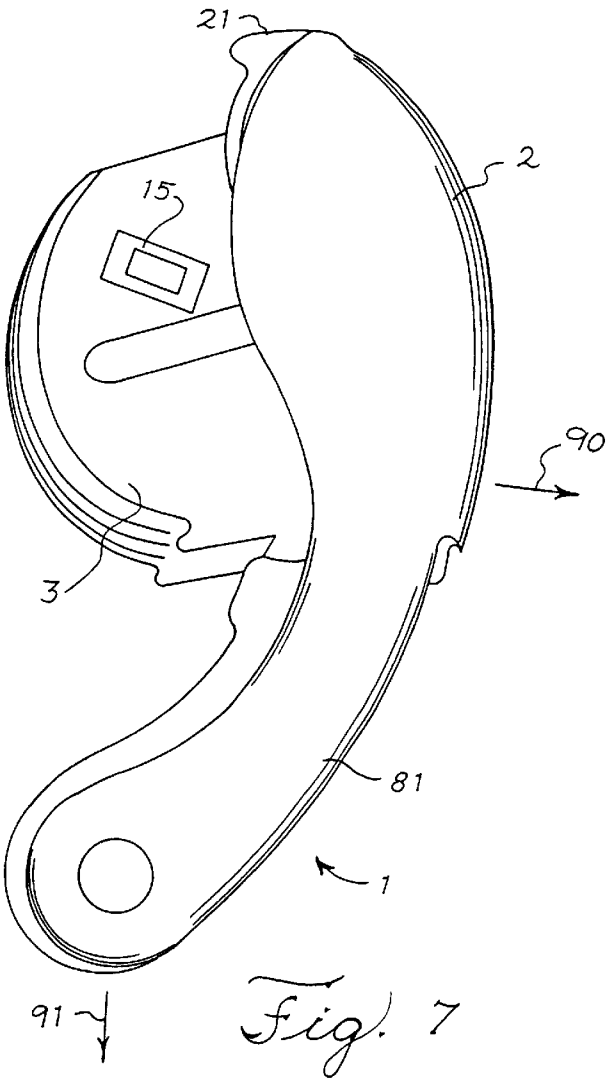

FIG. 7 is a side view of a dispenser.

Figure 8:
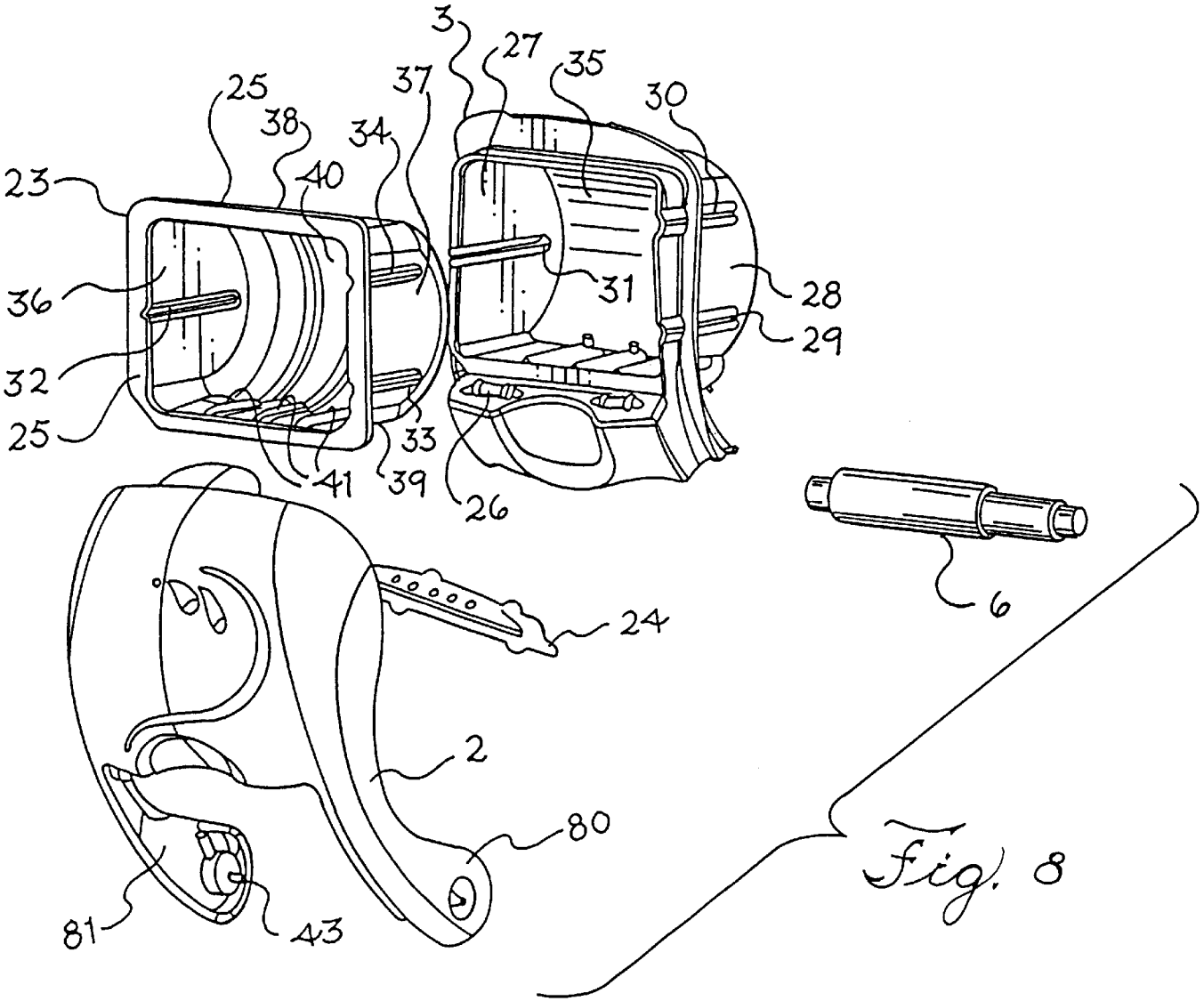
Figure 9:
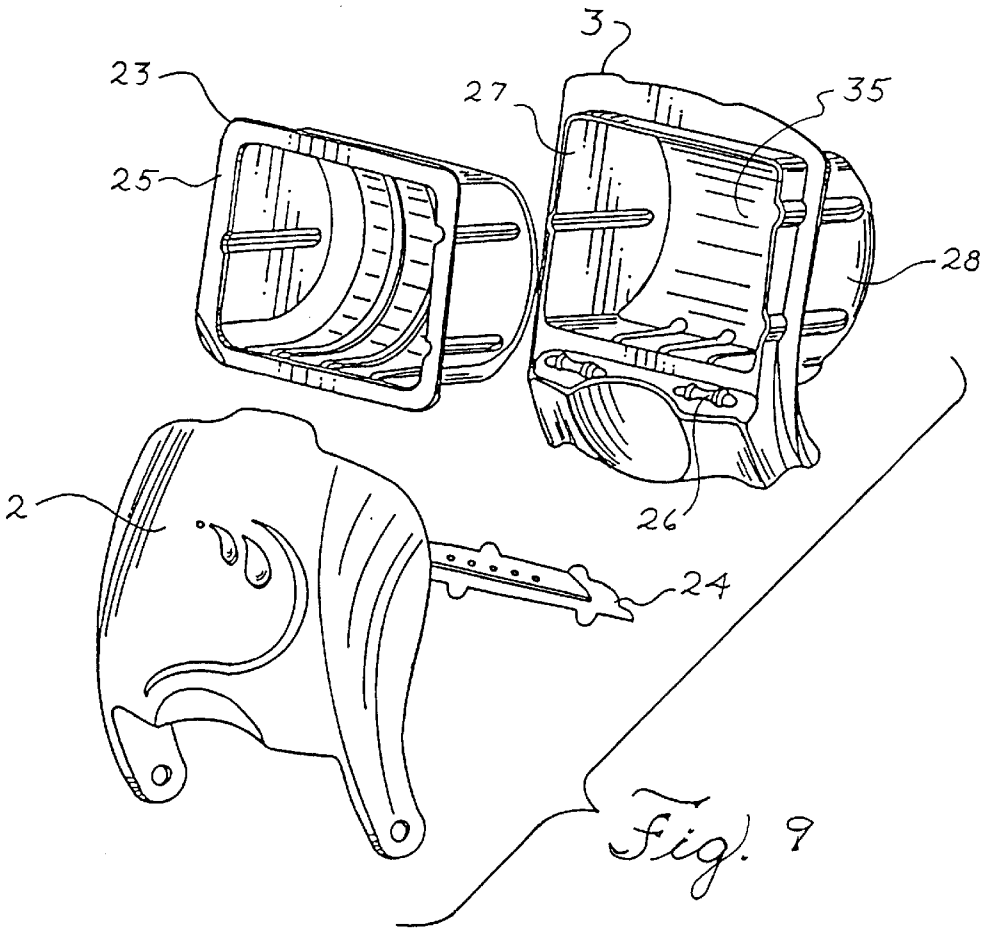
Figure 12:
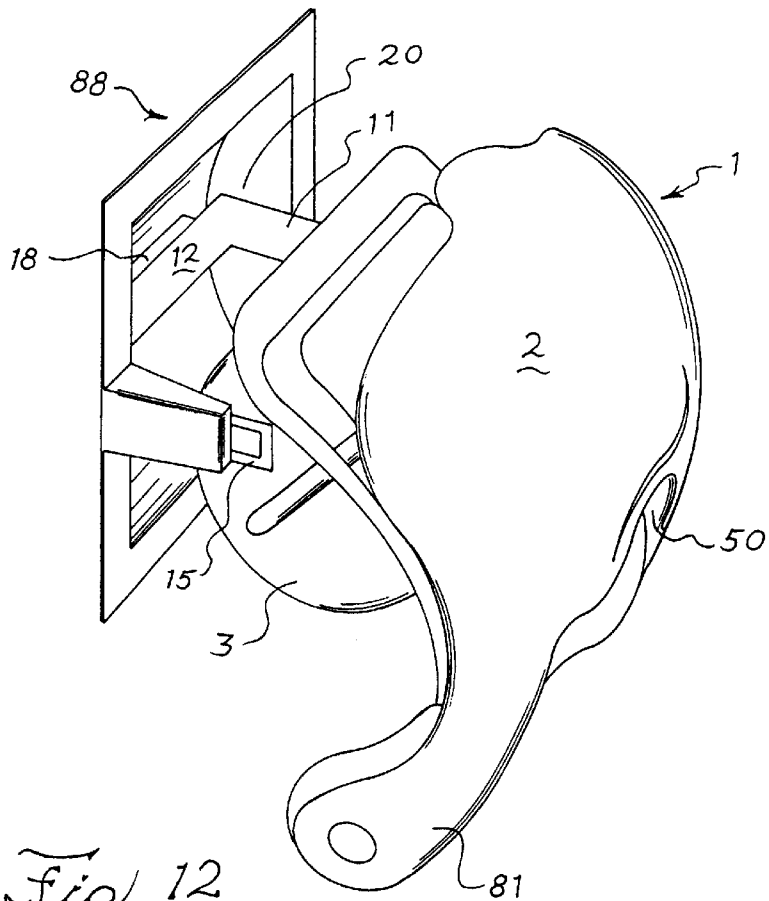

FIGS. 8–9 are exploded views of a dispenser.

Figure 10:
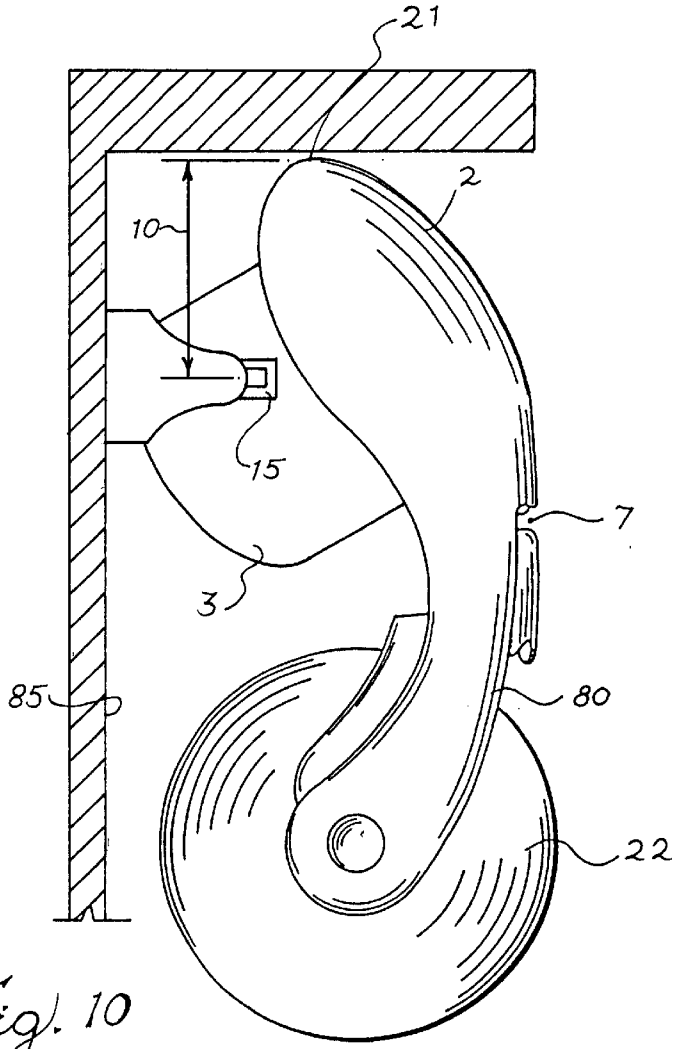

FIG. 10 is a side view of a dispenser mounted in a toilet tissue holder.

FIGS. 11–14 are perspective views of a dispenser mounted in a toilet tissue holder.

Figure 15:
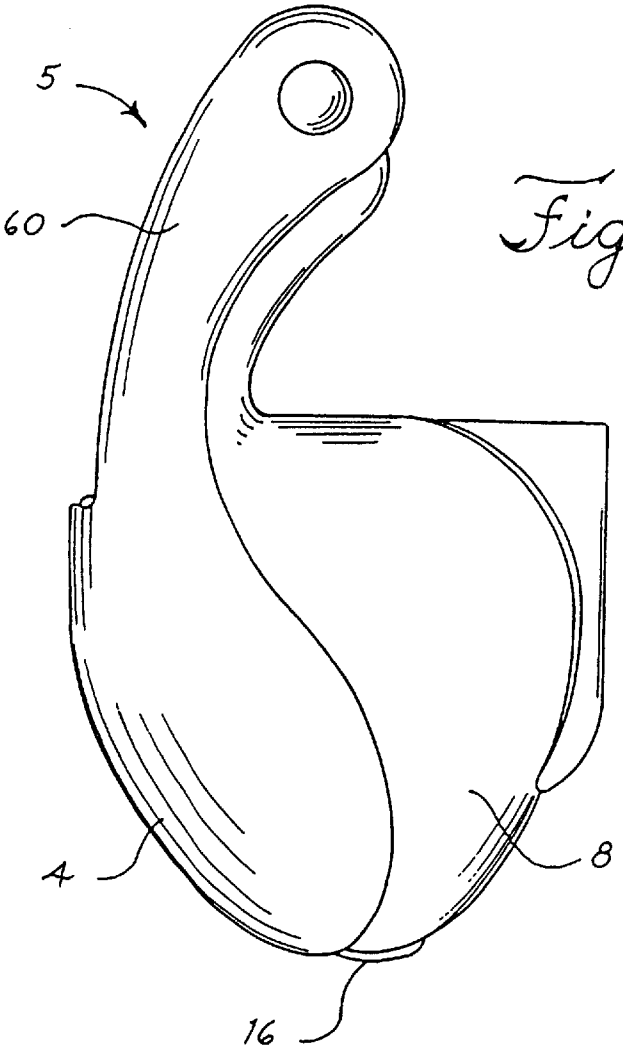

FIG. 15 is a side view of a dispenser.

Figure 16:
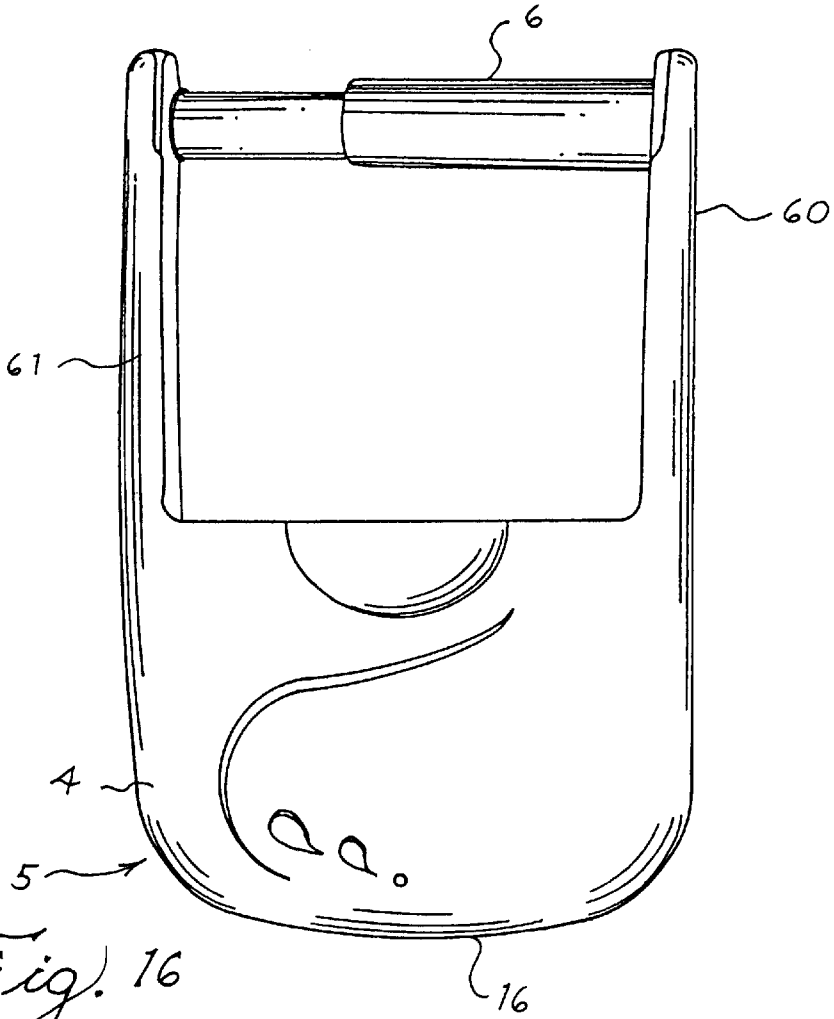

FIG. 16 is a front view of a dispenser.

Figure 17:
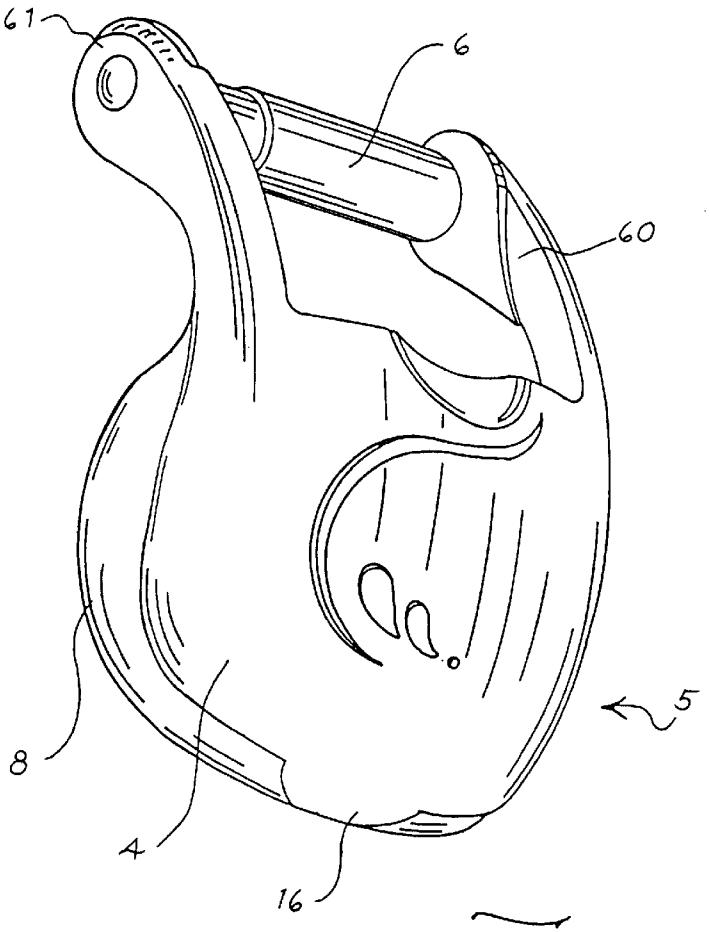

FIG. 17 is a perspective view of a dispenser.

Figure 18:
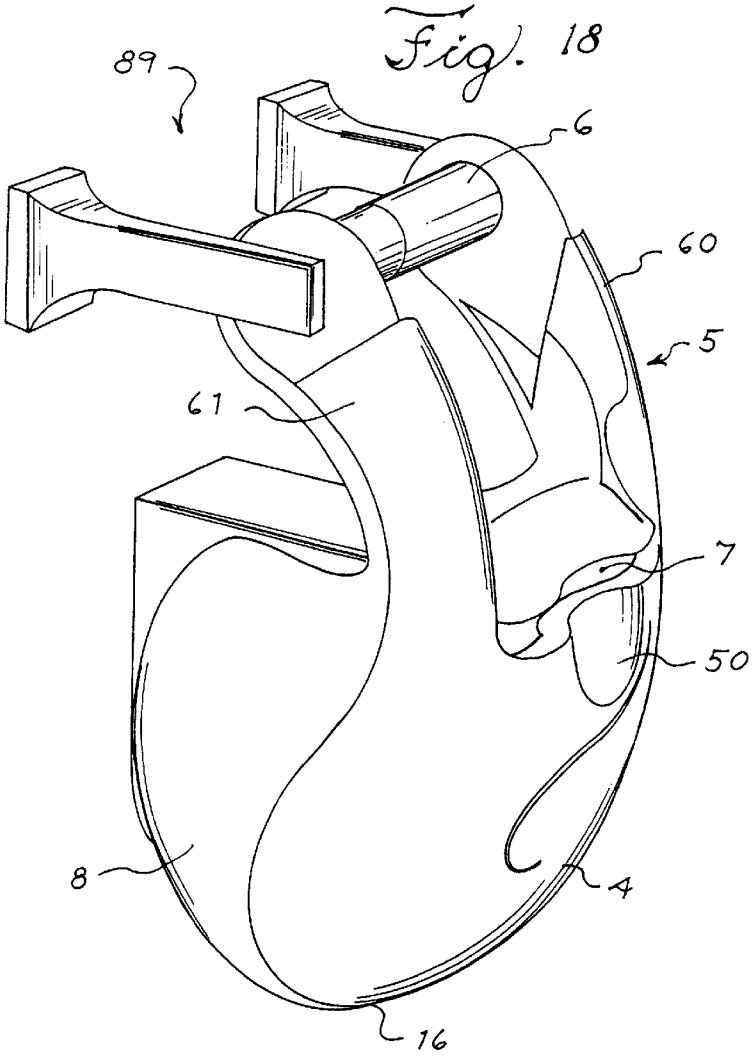
Figure 20:
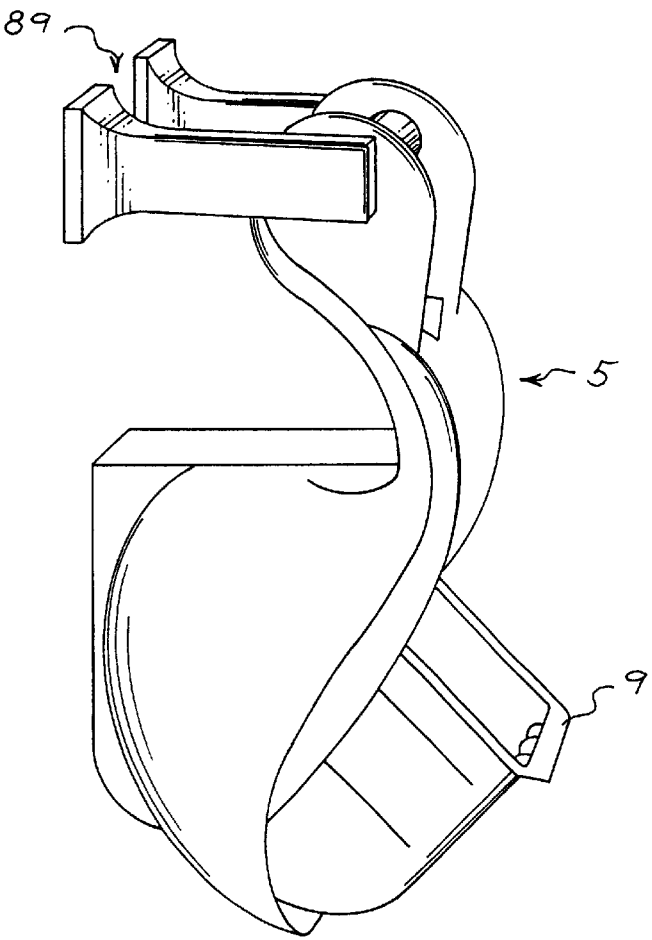
Figure 19:
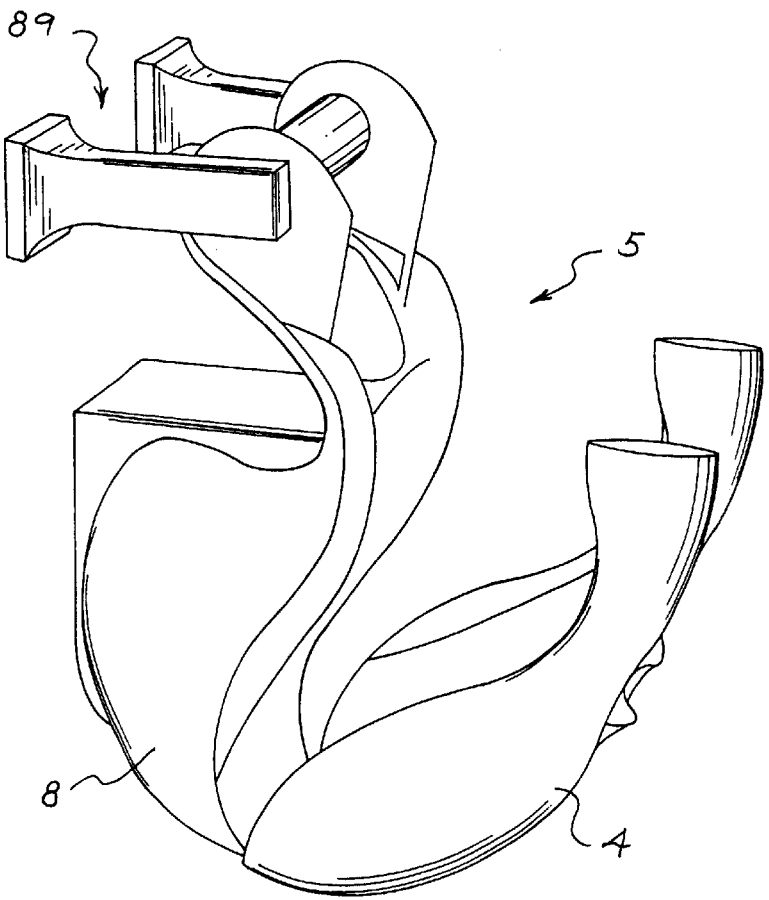
Figure 26:
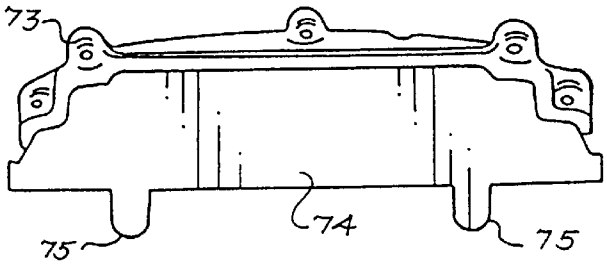
Figure 30:
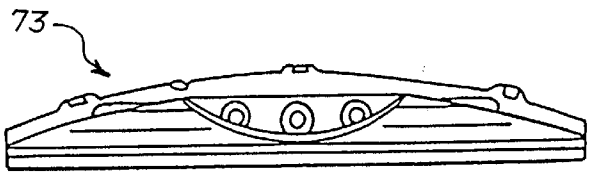

FIGS. 18–20 are perspective views of a dispenser mounted in a toilet tissue holder.

FIG. 21 is a perspective view of a roll of wet wipes.

FIG. 22 is a cross section view of a dispenser, a cartridge and a roll of wet wipes.

FIG. 23 is a cross section view of a cartridge and a roll of wet wipes.

FIG. 24 is a cross section view of a cartridge.

FIGS. 25–30 are views of a wiper blade assembly.

Figure 25:
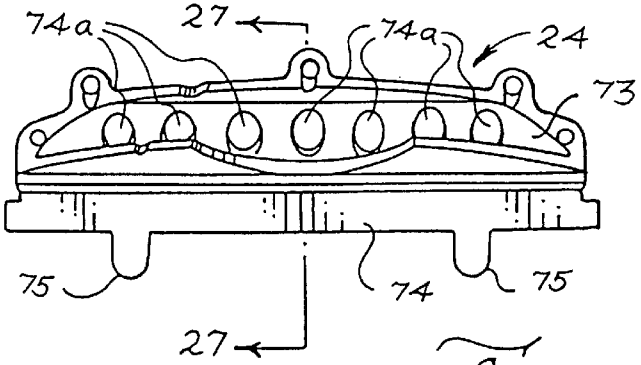
Figure 27:
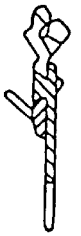

FIG. 27 is a cross section view of FIG. 25.

Figure 28:
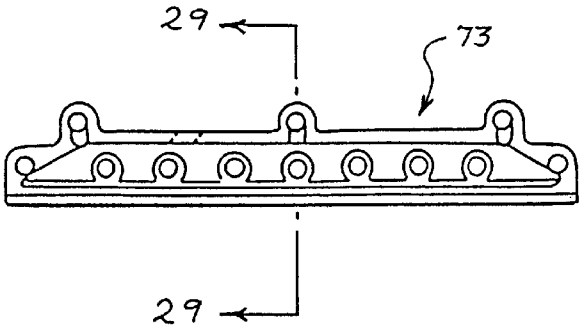
Figure 29:
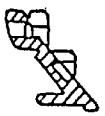

FIG. 29 is a cross section view of FIG. 28.

Figure 31:
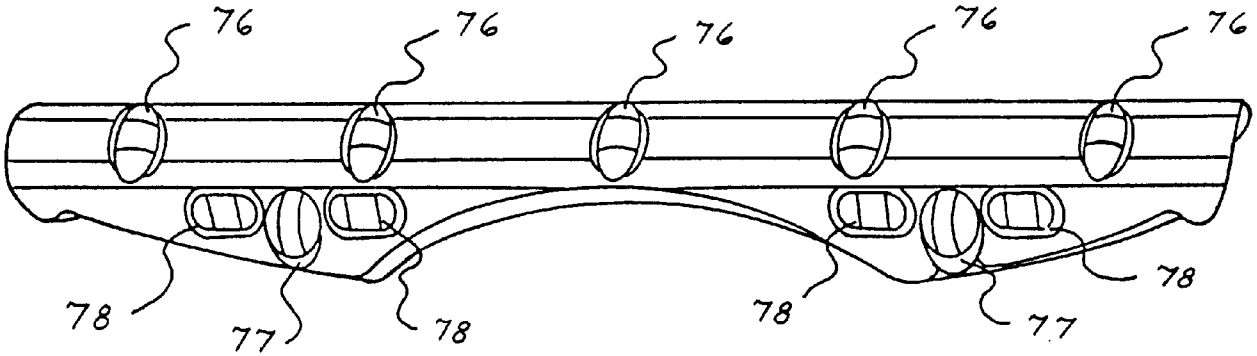
Figure 32:
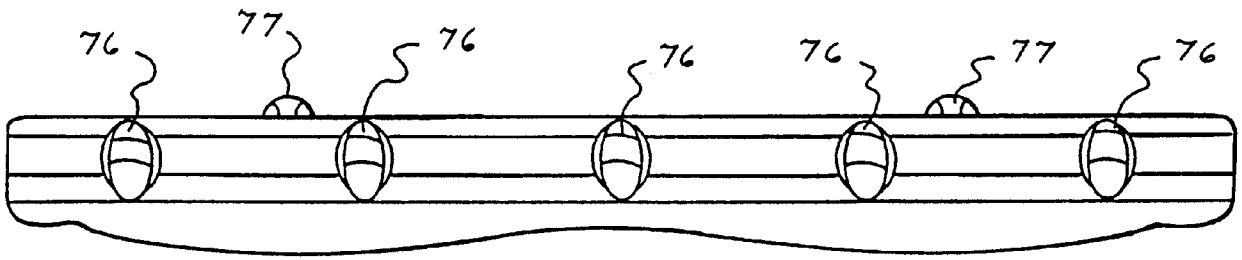

FIGS. 31–32 are views of a wiper.

Figure 33:
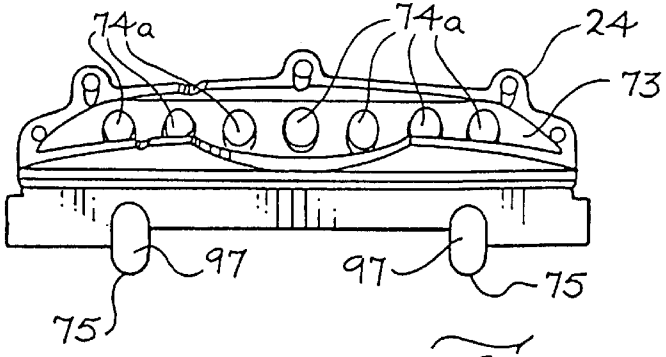

FIG. 33 is a front plan view of a wiper assembly.

Figure 34:
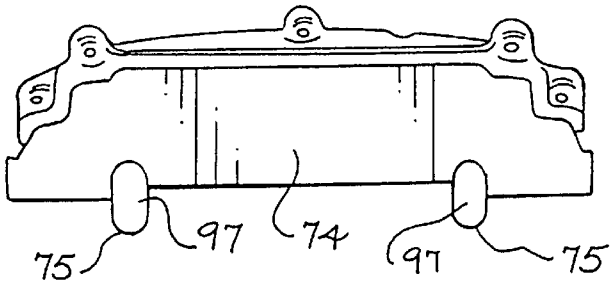

FIG. 34 is a front plan view of a wiper assembly.

Figure 35:
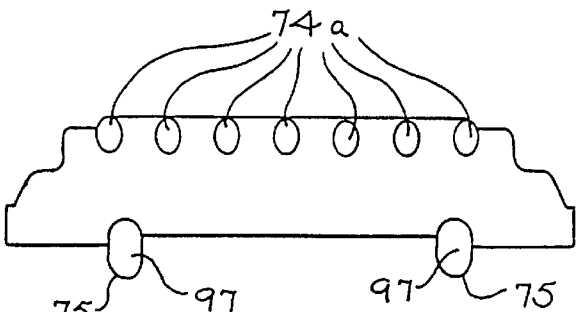

FIG. 35 is a plan view of a wiper blade.

Figure 36:
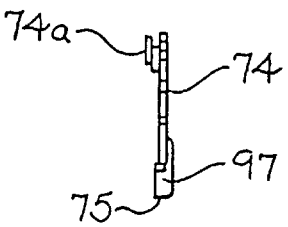

FIG. 36 is a cross-sectional view of a wiper blade.

Figure 37:
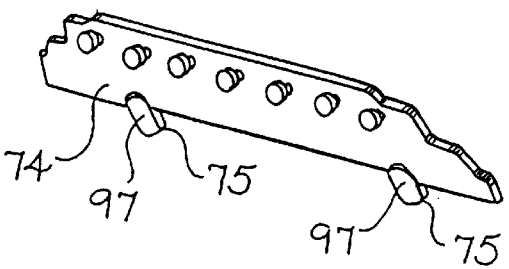

FIG. 37 is a perspective view of a wiper blade.

FIG. 38 is a perspective view of the inside of a cover.

FIG. 39 is a top view of the inside of a cover.

Figure 40:
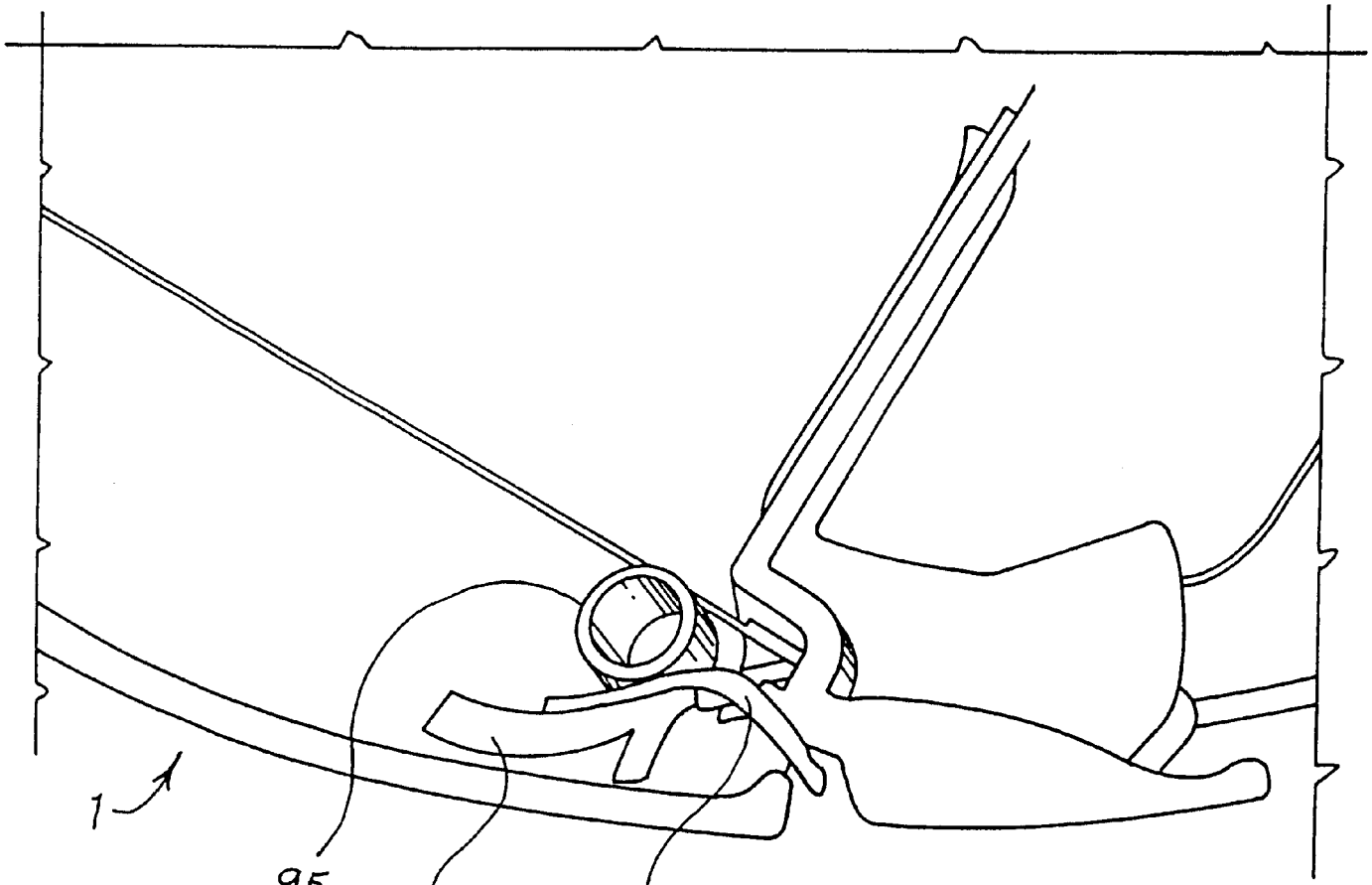

FIG. 40 is a cross-sectional view of a wiper.

FIG. 41 is a diagrammatic view of a bracket with springs.

FIG. 42 is a diagrammatic view of springs within a bracket.

Figure 43:
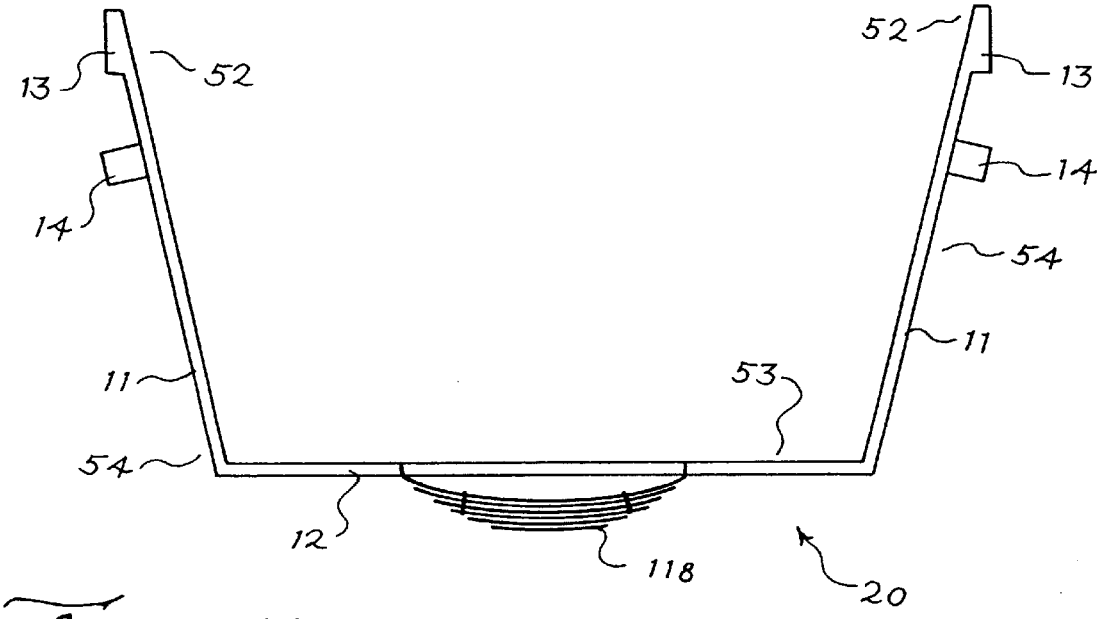

FIG. 43 is a diagrammatic view of a bracket with a spring as the shim.

Figure 44:
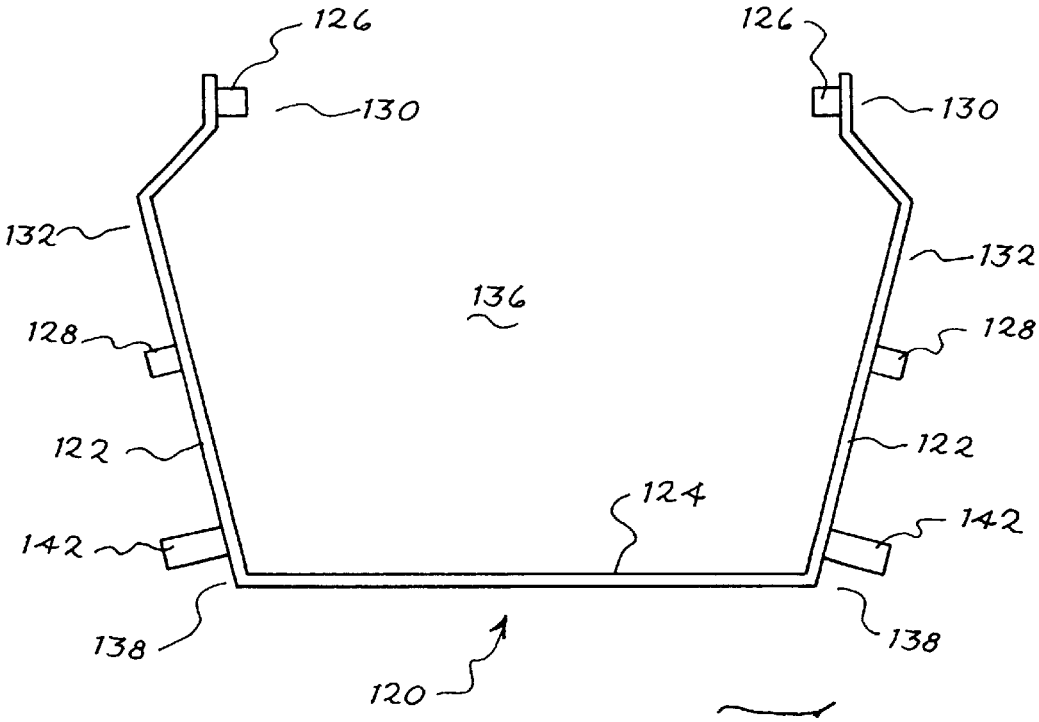

FIG. 44 is a diagrammatic view of a bracket.

Figure 45:
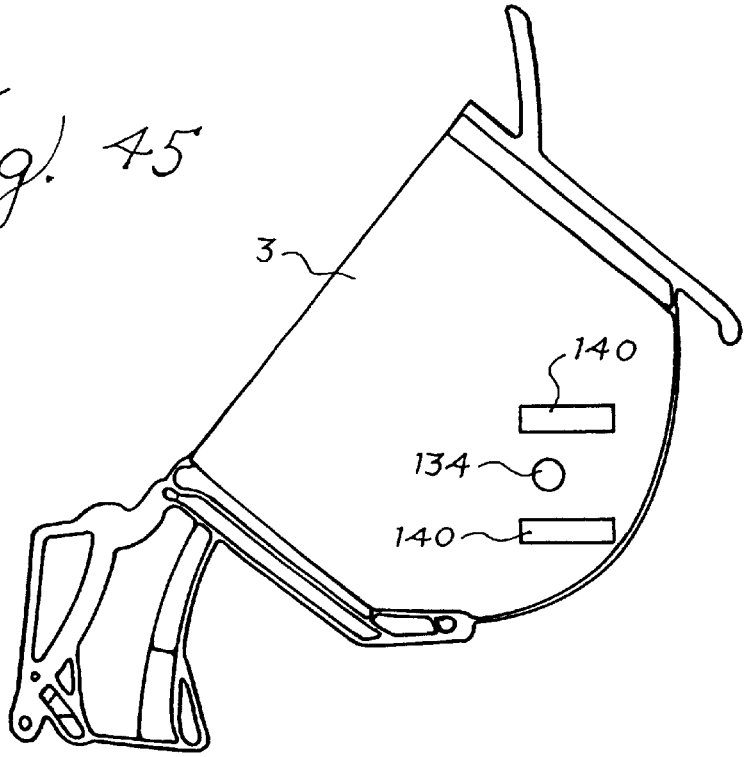

FIG. 45 is a partial side view of a housing.

Figure 46:
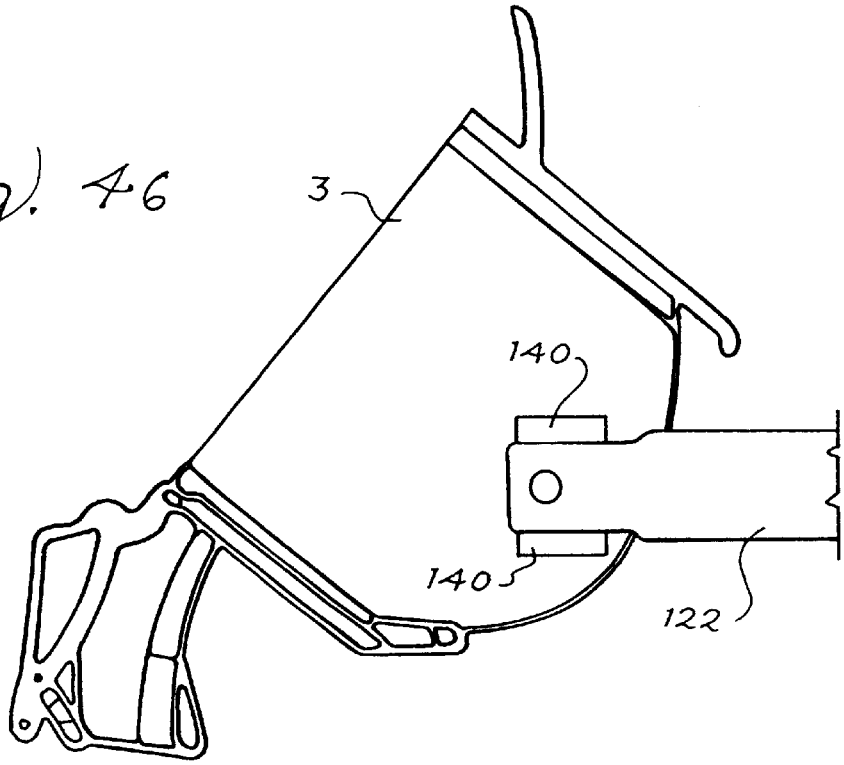

FIG. 46 is a partial side view of a housing connected to a bracket.

DETAILED DESCRIPTION

In general there is provided a dispenser for wet wipes which can be mounted in a conventional bathroom tissue holder such that the dispenser is securely, yet removably attached to the holder. A conventional bath tissue holder is the type that is typically found in a home, for example as illustrated in FIGS. 1–2. Such holders 88 and 89 have posts 86 that protrude from a wall or a surface and a rod or roller 6 that may be positioned between the posts, typically along axis 84. The posts may be equipped with indentations 87 to facilitate the engagement of the roller with the posts. For a holder 89 mounted to a planar surface (FIG. 2), the rear periphery 85 is the surface or wall on which the posts are mounted. The holder may be partially recessed into the wall, such as 88 in FIG. 1, in which case the rear periphery 85 is formed by the recessed portion of the holder.

The device of the present invention, in generality, includes a dispenser which can be mounted in a conventional toilet tissue holder, even when the holder is configured in such a way that there is a reduced clearance between the holder and another object. For example, the holder may be positioned near an overhanging ledge or a countertop, or another object may be mounted near the holder. In these instances, the presence of an obstruction above the holder may prohibit the proper mounting of a typical dispenser or may hinder access to the dispenser and its contents. Examples of typical dispensers are described in co-pending application Ser. No. 09/659,307, filed Sep. 12, 2000, the disclosure of which is incorporated herein by reference. For typical dispensers, access may be hindered if the distance between the axis 84 of the holder and the obstruction is less than about 7 inches. Mounting of the dispenser may be problematic if the distance between the axis 84 and the obstruction is less than about 5¼ inches.

Referring to FIG. 10, for a dispenser to be mounted in a conventional toilet tissue holder having a reduced vertical clearance, this mounting can accommodate a distance 10 between the top 21 of the dispenser and the axis of the holder that is less than 5 inches, more preferably less than 4 inches, more preferably less than 3 inches, more preferably less than 2 inches.

The dispenser may be equipped with a mounting bracket which is attached to the dispenser and which engages the posts of the holder. The mounting bracket provides for the secure mounting of the dispenser to the holder by the engagement of the bracket with the posts of the holder and the rear periphery of the holder.

The mounting bracket may be integral with the dispenser. The bracket may be removably attached to the dispenser, such as by the cooperation of a tab and a lock or by snaps. For dispensers which are removably attached to a mounting bracket, the dispenser may be mounted in the toilet tissue holder by attaching the bracket to the dispenser and then engaging the bracket with the toilet tissue holder. The dispenser may also be mounted in the toilet tissue holder by engaging the bracket with the toilet tissue holder and then attaching the bracket to the dispenser. The bracket may be made from any suitable material, such as plastic, wood, ceramic, porcelain, glass, metal, thermoplastic elastomers, or composite materials. For example, the following materials may be used to make the dispenser: polypropylene; polyesters such as polybutylene terephthalate (Pbt); Pbt glass filled; Pbt 15% glass filled; polycarbonate; polyvinyl chloride; metal; fiberglass; carbon fiber; and acrylonitrile-butadiene-styrene (ABS).

Referring to FIGS. 3–4, a bracket 20 has arms 11 that extend from the back piece 12 of the bracket. These arms may be perpendicular to the back piece and parallel to each other, or they may be set at an angle. The arms have tabs 13 at the front 52 and also have protrusions 14 on their exterior 54. The protrusions are designed to engage the posts of the toilet tissue holder, desirably such that the back piece is proximate the rear periphery of the holder. The tabs are designed to mate with corresponding sleeves 15 on the dispenser, thus securely positioning the dispenser within the interior 55 of the bracket. The back piece may be equipped with a shim 18 at the rear 53 of the bracket. This shim may have fixed dimensions or may be adjustable.

Referring to FIGS. 44–46, a bracket 120 has arms 122 that extend from the back piece 124, and may be perpendicular to the back piece or may be set at an angle. These arms have tabs 126 at the front 130 and protrusions 128 on their exterior 132. The protrusions are designed to engage the posts of the toilet tissue holder. The tabs are designed to mate with corresponding cavities 134 on the dispenser to position the dispenser within the interior 136 of the bracket. The front of the arms may be retained in a specific orientation relative to the dispenser by interaction with the bracket guides 140 on the dispenser. The orientation of the arms relative to the dispenser may also be stabilized by the shape of the tabs and the cavities. For example, the tabs and cavities may be shaped like a rectangle, a star, or a hexagon such that the dispenser is prevented from rotating about the tabs. The rear of the arms 138 may have stabilizers 142. The stabilizers serve to stabilize the orientation of the dispenser and the bracket relative to the toilet tissue holder. The back piece may further be equipped with a shim at the rear of the bracket as illustrated in FIGS. 3 and 41–43.

The tabs, protrusions, shim and/or stabilizer may be capable of compression. For example, they may be made of rubber, flexible foam, or any compression resilient material; or they may be equipped with compressible springs. Compression resilient materials include for example sponge, foam, and thermoplastic elastomers such as KRATON, styrene-ethylene/butylene-styrene (SEBS), and SANTOPRENE. Compressible springs include for example coiled springs, torsion springs, and leaf springs. Referring to bracket 100 in FIG. 41, the tabs 102, protrusions 104, and shim 106 may independently have a stationary section B and a section A which is movably attached to the bracket. The tabs, protrusions, and shim may then contain a compression resilient material, or may contain a spring. In the embodiment pictured in FIG. 42, the shim and the protrusions contain coiled springs 112 and 114, and the tabs contain torsion springs 116. Referring to FIG. 43, the shim may be a leaf spring 118.

It is preferred that the shim is constructed such that the back piece can be made to approach the rear periphery of the holder by compression of the shim, allowing for engagement of the protrusions with the posts of the holder. The bracket may have a variety of shapes and sizes provided it is compatible with the existing toilet tissue holder. The distance between the arms at the rear of the bracket may be less than 7 inches, less than 6 inches, and less than 5 inches.

The mounting bracket desirably exerts a force, along axis 84, on each of the two posts of the conventional bath tissue holder. This force can be expressed in terms of the magnitude of the force divided by the mass of the dispenser to provide the normalized force. The mass of a dispenser depends on the size and shape of the dispenser, as well as the materials used to make the dispenser. Typically, dispensers may have a mass between 100 and 5,000 grams, between 150 and 2,000 grams, and between 200 and 1,500 grams.

The mounting bracket provides a manner of affixing the dispenser to a toilet tissue holder so that, when affixed, the dispenser is secure to reduce wobbling during use. Thus, the dispenser is held in place during use with little or no wobbling. The reduction or elimination of wobbling may occur under most, if not all, conditions of normal use, such as for example, when wipes or conventional tissue are removed smoothly, roughly, in a slashing manner or by any other common manner of using such products. For example, the dispenser can withstand a normal force shown as arrow 90 in FIG. 7, a vertical force shown as arrow 91 in FIG. 7, and a side force shown as arrow 92 in FIG. 5 of 890 g for about 10 minutes without deflecting, moving, or wobbling. Preferably, the dispenser can withstand a normal force, a vertical force, and a side force of 1116.6 g for about 10 minutes without deflecting, moving, or wobbling. The dispenser can also be affixed to a surface, such as a wall, by other means such as glue, nails, screws, rivets, magnetic attachments, staples, engaging brackets and pressure mountings.

The mounting can be facilitated by the coordination of the bracket with the indentations of the posts. For example, the protrusions 14 on the bracket 20 may mate with the indentations 87 on the posts of the holder. The bracket may be configured such that the arms 11 can be flexed or pivoted towards the interior 55, allowing the bracket to be positioned between the posts of the holder. The dispenser may be mounted to the holder by first mounting the bracket in the holder and then mounting the dispenser on the bracket. The dispenser may also be mounted to the holder by connecting the bracket and dispenser and then mounting the bracket and dispenser to the holder. If the bracket and dispenser are connected to each other before being mounted into the holder, it is desirable that the bracket and dispenser together have sufficient flexibility or compressibility to allow the bracket and dispenser to be positioned between the posts of the toilet tissue holder.

Referring to FIGS. 3 and 4, the bracket may have tabs 13, and the dispenser may have sleeves 15. The tabs and sleeves can coordinate to removably connect the bracket and the dispenser. The sleeve may be configured with a single opening for receiving the tab, or it may be configured with more than one opening. The presence of more than one opening may facilitate removal of the tab from the sleeve to disconnect the bracket and dispenser. That is, the tab can be forcibly pressed into the sleeve, allowing the tab to slide out of the sleeve. The length of the tab may be between 2 cm and 4 cm. The width of the tab may be between 1.5 cm and 3 cm. The height of the highest part of the tab, as measured from the surface of the dispenser, may be between 0.5 cm and 2 cm. The tabs and sleeves may be of any shape provided they can coordinate together. The tabs and sleeves may have square edges, they may be rounded, or they may be pointed or angled. The tabs and sleeves may be asymmetric to facilitate the connection of the bracket and dispenser in only one orientation (i.e., a lock and key coordination). The dispenser and bracket may be configured such that they may be connected and disconnected easily by the user. It is desirable that no tools are required to connect or disconnect the dispenser and bracket, especially such that the dispenser and bracket can be connected by the user with only one hand.

Referring to FIGS. 5–14, a dispenser 1 may have a cover 2 and a housing 3. The housing and the cover may be separate, separable components; they may be integral; or they may be fixed together or removably mounted together. For example, the cover can be hingedly attached to the housing so that the front cover can swing open for placing wipes in the dispenser and then swing shut. The cover may also be clear or translucent, or may have a window in it to provide a way to visually determine the amount of wipes in the dispenser. The cover and the housing form a gap 7, through which a wet wipe can extend. That portion of the wipe extending through the gap may be referred to as a tail. The housing and cover may additionally have recesses 50 that form an indentation that provides a finger hold, or point where a user can grasp the wet wipe to pull it from the dispenser. Although optional, this dispenser is also provided with a roller 6 for mounting and dispensing conventional bath tissue or other rolled products. The dispenser may also have arms 80 and 81 that extend from the dispenser to hold the spindle or roller 6 for supporting a roll of another product, such as dry or conventional bath tissue. The arms may also support a means of dispensing, storing, containing or mounting a product such as wipes, toilet tissue, or the like. For example, the arms may support a shelf which may in turn support a container of wet wipes having the same or a different composition from that of the wipes in the dispenser.

The dispenser may be configured such that the wet wipes are dispensed from an area below the conventional toilet tissue holder. Referring to FIGS. 15–19, the dispenser 5 may have a front cover 4, a back cover 8, and arms 60 and 61. The arms may engage the posts of the toilet tissue holder, allowing the dispenser to be mounted below the holder. The arms may also provide for a roll or roller 6 to be mounted such that conventional toilet tissue can be dispensed. The front cover and back cover may be removably or hingedly attached to each other, such as at the bottom 16 of the dispenser. In this way, the front cover can be removed or pivoted, and the wet wipes can be placed in the dispenser. The dispenser may also have a tray 9 as illustrated in FIG. 20. The wet wipes can be placed in this tray and can be dispensed, with or without the front cover.

Referring to FIGS. 8–14 the cover 2 and housing 3 may have holding or locking devices to fixedly, removably or hingedly hold them together during use. When closed, the cover and housing form the dispenser. Various ways to lock or fix the cover to the housing may be employed. For example, a lock and key approach may be desirable in commercial, industrial or institutional applications or in houses where there are small children present. Likewise, the front cover 4 and back cover 8 (FIGS. 15–19) may have holding or locking devices.

The dispenser and its components may independently be made from any suitable material, such as plastic, wood, ceramic, porcelain, glass, paper, metal, thermoplastic elastomers, or composite materials. For example, the following materials may be used to make the dispenser: polypropylene; polyesters such as polybutylene terephthalate (Pbt); Pbt glass filled; Pbt 15% glass filled; fiberglass; carbon fiber; and acrylonitrile-butadiene-styrene (ABS). The cover may have different shapes and sizes. When the dispenser is intended for use in a home it is desirable that the cover be of a size that is similar to conventional bath tissue roller mounts. It is particularly desirable that the dispenser be as compact as possible for home use. Further if the cover is in the range of from about 4½ inches (114.3 mm) to 6⅞ inches (174.6 mm) in width it will be able to aesthetically fit in or mount to the vast majority of toilet paper holders that are in existing houses. The width of the cover may be greater than about 3 inches (76.2 mm), less than about 6 inches (152.4 mm), less than about 7 inches (177.8 mm), and less than about 8 inches (203.2 mm). The 4½ inches (114.3 mm) by 6⅞ inches (174.6 mm) size provides an added benefit of enabling one size of dispenser to be used in the vast majority of applications in the home, although smaller sizes may be desirable for certain applications or aesthetic reasons, such as a small bathroom. The dispenser and its components may have varied colors, such as the almonds and whites that are seen in porcelain bath fixtures or may have any other desirable color.

The dispenser is held in place during use with little or no wobbling. The reduction or elimination of wobbling may occur under most, if not all, conditions of normal use, such as for example when wipes or conventional tissue are removed smoothly, roughly, in a slashing manner or by any other common manner of using such products.

Figure 11:
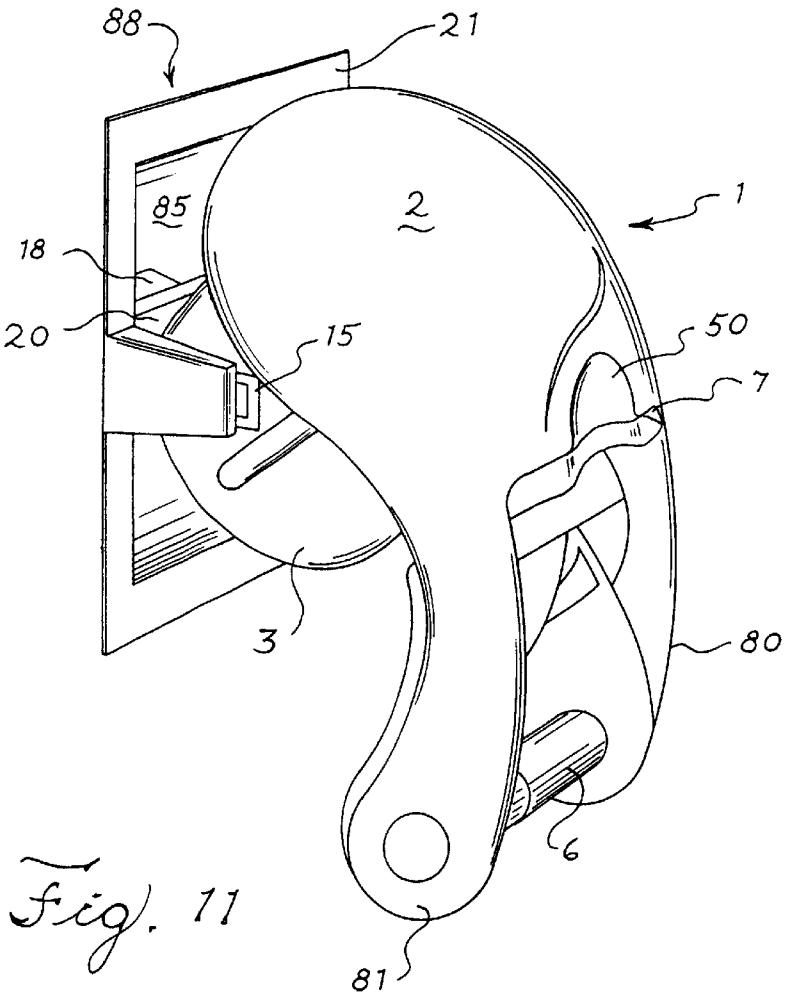
Figure 14:
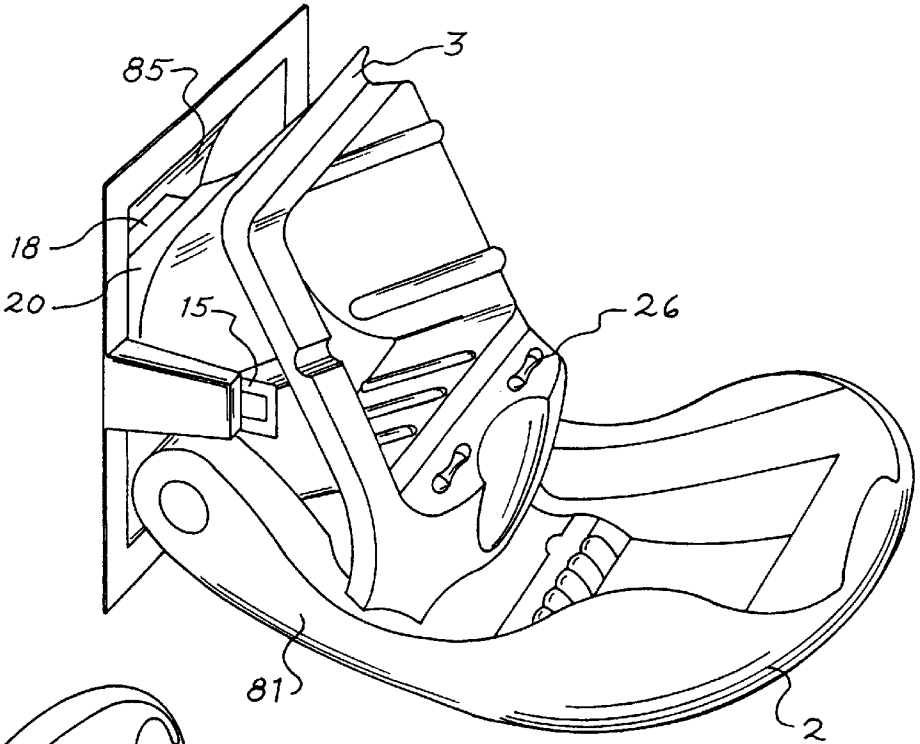
Figure 13:
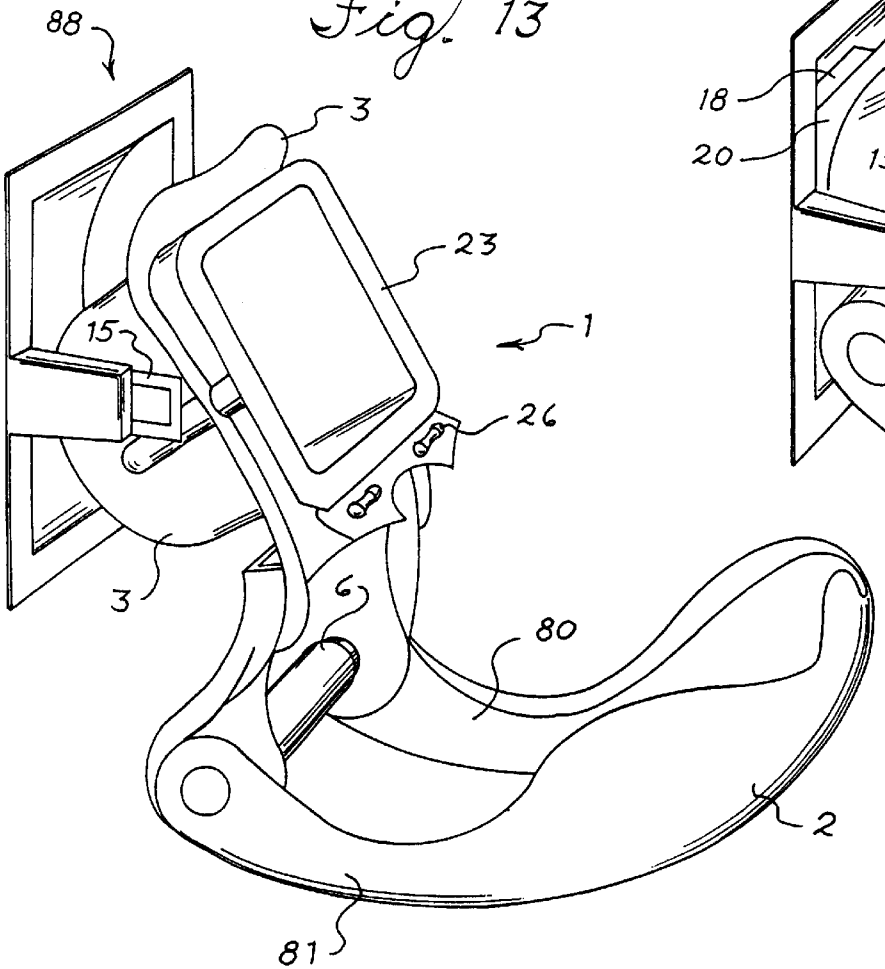

Referring to FIGS. 5 and 6, the bracket and dispenser may be configured such that the bracket is concealed from the line of sight when viewed from the front. Referring additionally to FIG. 11, the bracket may be substantially concealed from view when viewed at an angle, especially when the toilet tissue holder is recessed. Thus, the bracket does not appear to the user to be an additional, obtrusive piece of hardware.

The cover may be clear or have a window for viewing the amount of wet wipes that remain in the dispenser. It is noted, however, that because the front cover may be in direct contact with the wet wipe, since the cover forms a top for the cartridge when the cartridge is inserted into the dispenser and the cover closed, wood or any other material that would support bacterial growth would not be favored. It is desirable that all materials that are in contact with or associated with the wet wipes be made from materials that discourage, or do not support bacterial growth.

Referring to FIGS. 8–9, the cover 2 is designed to form a barrier to moisture loss from the wet wipes. This barrier may be formed due to cooperation with other components of the dispenser system, such as the housing 3 or a cartridge 23 of wet wipes. The dispenser can maintain wet wipes in a moist condition when fully closed for at least 1 day, for at least 2 days, for at least 5 days and for at least 14 days, and preferably for more than 14 days at room conditions of 73° F. (22.8° C.) and 50% relative humidity. The dispenser when fully closed can maintain at least about 15%, at least about 20%, at least about 25%, at least about 50% and at least about 95% of the moisture of the wipes for a 14 day period at 73° F. (22.8° C.) and 50% relative humidity. These moisture retention values can be obtained with a tail of the wipe protruding through the gap, the tail having a length of not more than 1.5 inches (38.1 mm).

The cover 2 may further be designed to cooperate with the cartridge 23, the housing 3, or other components of the dispenser system, to form a barrier to contamination of the wipes within the dispenser. Thus, the cover in cooperation with the cartridge, or other components of the dispenser system, may form a barrier to dirt, dust, mold spores and bacteria.

The space between the inner surface of the cover and the surface of the lip of the cartridge may vary between about 2 mm and about 10 mm. In this way there is formed a dome above an open cartridge that at least partially covers that opening, which dome may be less than about 15 mm, less than about 10 mm, less than about 5 mm and ideally is less than about 2 mm above the lip of the cartridge. The height of the dome may also be measured from the surface of a full roll of wet wipes in which an additional 2 to 7 mm may be added to the height of the dome. Higher domes may also be employed, but such higher domes may be less aesthetically pleasing and may provide for greater amounts of evaporation or moisture loss from the wet wipes.

The cover and wiper assembly 24 cooperate with the lip 25 of the cartridge. In this way when the cover is closed the inside rim is brought against the lip of the cartridge and the wiper blade is similarly brought against the tray including the guides, as well as the lip of the cartridge.

The distance between the inside of the cover where the wiper is located and the tray may be less than the thickness of the wiper blade. Thus, in this configuration the wiper blade would be placed under compression against the lip, the tray, or the guides 26 or all of them depending on the position of the wiper. Here the wiper blade would exert pressure on the wet wipes. The wiper may also be positioned so that it contacts the wet wipe but does not exert pressure against it, or be positioned so that it is a short distance above the wet wipe. The amount of pressure that the wiper blade exerts on the wet wipe may vary depending upon several factors, including the purpose for the wiper, the material that the wiper blade is made from, the material that the wet wipe is made from and the material that the cartridge lip 25 is made from. Thus, the wiper may be configured and positioned to prevent the tail of the wipes from withdrawing, or being pulled back to the dispenser, such as for example by the weight of the roll.

The housing 3 may be made from any similar material to the cover, and it may be the same material or different material from those components. The housing may have side walls 27 and 28 and a back wall 35. The side walls may be provided with recesses 29, 30 and 31. These recess cooperate with protrusions 32, 33 and 34 on the cartridge (32 with 31, 33 with 29, and 34 with 30). In this way the cartridge is securely, yet easily removably held in the dispenser. The housing is sized in relation to the cartridge (or the cartridge may be sized in relation to the housing) so that the cartridge can easily be slid into and out of the dispenser.

As is apparent from FIG. 8–9, the housing and cartridge are not symmetrically shaped, i.e., they are asymmetric. The asymmetry of the tray and cartridge results in a keyed type arrangement that allows the cartridge to be inserted fully or properly in only one orientation into the dispenser. This can assure that the roll of wipes will unwind from a predetermined orientation, i.e., from the bottom of the roll or the top of the roll. For example, in the embodiment shown in FIG. 8–9 the asymmetry in the vertical plane is obtained by having a different number and location of protrusions and recesses on opposite sides. It is recognized that any suitable means to accomplish asymmetry may be employed, such as notches, tongue and groove, the shapes of the opening and detents, the shape of the lip, the shape of the walls, and the dimensions of the cartridge walls. For example, some of the cartridge walls may be flat while others are rounded, or the cartridge lip may be non-planar. Additionally, labeling or marking of the cartridge, the housing, or both can create the effect of asymmetry.

The cartridge may be made out of any suitable material, such as plastic. It is preferable that the cartridge be made from a light weight, inexpensive, disposable and recyclable material. The cartridge has side walls 36, 37, 38 and 39 and bottom wall 40. The cartridge has a lip 25 that forms an opening in the cartridge. The cartridge has ribs 41. The ribs may extend part way or all the way along the sides 38 and 39 and the bottom 40. The ribs may cause grooves or indentations to form in the rolls, depending on the density of the roll and conditions of use. These grooves are not necessary to the use of the dispenser system.

The cartridge may be any shape or size provided that it fits in or cooperates with the dispenser. For example a cartridge that would be useful for application in the home would have side walls 36 and 37 that are less than 105 mm and side walls 38 and 39 that are less than 134 mm. The roll or stack of wipes may also be placed directly in the tray for dispensing, without the use of a cartridge. Examples of rolls of wet wipes as well as cartridges are described in the above-mentioned co-pending application Ser. No. 09/659,307.

In general the dispenser system illustrated herein can be used with or without conventional dry toilet or bath tissue. If conventional tissue is used with wet wipes it could be positioned above, below, behind or in front of the wet wipes. Referring to FIG. 8, the cover may also have cover mounts 43, which may be configured to receive a conventional toilet tissue roller.

FIG. 21 shows a roll of wipes 46 that has a tail 67 and further defines the axis of the roll as 68. In use the tail of the wet wipe would be grasped and pulled generally in the direction of arrow 69 causing the roll to unwind and the wipe to be dispensed from the dispenser. In use the wet wipe may also be subjected to forces tangential and perpendicular to the direction of arrow 69. If these forces occur the guides and the wipers help to prevent the wipe from skating to one side of the gap and bunching up or binding.

Rolls useful with this dispenser or as part of a dispensing system may contain from as little as a few linear inches (or cm) to more than 450 linear inches (11.43 m), to more than linear 600 inches (15.24 m) to more than a thousand linear inches (25.40 m) of wet wipes. The rolls may have a web of material that may have any number of sheets. Usually, the sheets are separated by perforations that enable the sheet to be easily torn from the web but are strong enough that they will not separate while the web is being pulled from the dispenser. An example of a roll that is particularly useful for applications in the home is one that has a diameter of about 2 inches (50.8 mm) to about 3 inches (76.2 mm), of about less than 5½ inches (139.7 mm), and may have a diameter of about 3 inches (76.2 mm) or about 2⅞ inches (73.0 mm). This roll has from about 400 linear inches (10.16 m) of wipes to about 1000 linear inches (25.40 m) of wipes. Without limitation, each sheet length may be from about 3 inches (76.2 mm) to about 10 inches (254.0 mm) and may be about 4.5 inches (114.3 mm). This roll may further have a density of from about 0.3 g/cc to about 1 g/cc, from about 0.5 g/cc to about 1 g/cc and about 0.62 g/cc. A particular example of a roll may be one having a diameter of about 2 inches (50.8 mm) and containing about 450 linear inches (11.43 m) of wipe. Another particular example of a roll may be one having a diameter of about 3 inches (76.2 mm) and containing 450 linear inches (11.43 m) of wipes.

A desirable form of wet wipes for use with the dispenser system is a solid coreless roll as shown in FIG. 21. It is to be understood, however, that cored rolls (hollow cores, solid cores and partially solid cores), hollow coreless rolls, and stacks of sheets may also be used in the dispenser system. When density values are referred to herein, it is for the density of the roll and this would exclude any void, for a coreless hollow roll, or space occupied by a core for a cored roll.

FIG. 22 shows the roll 46 as it is placed in a cartridge in a dispenser. The spiral line 70 is intended to represent the manner in which the roll is wound and depicts in that configuration a roll that is being unwound from the bottom. That Figure further shows the relationship of the wiper 24 to the wet web. FIG. 23 shows the roll 46 in cartridge 23, with spiral line 70 indicating the wind of the roll. This Figure shows the relationship of the roll and the ribs 41. As can be seen from this Figure the roll is lifted off of the side and back walls of the cartridge by rib 41. Thus, the amount of surface of the roll that is in contact with the cartridge is reduced. This in turn reduces the drag that the roll experiences from friction with the cartridge when the roll is turned.

FIG. 24 shows a portion of a cartridge 23, the lip 25 of the cartridge, and the side walls 38 and 39. The angle at which the cartridge is positioned has an effect on how well the dispenser will perform. The angle will have a tendency to add or reduce the drag associated with pulling the wipe out. It will have an effect on the amount of siphoning, wicking or drying that may take place in the wet wipe. It may also have an effect on how the roll acts as it is unwound, becoming smaller and smaller in the cartridge. The angle of the cartridge can be measured by the angle that the lip 25 forms with a true vertical axis, shown as 71. For a dispenser system as shown in FIGS. 22–23, the angle 72 that the lip 25 has with a true vertical axis 71 should be from about 10 degrees to about 80 degrees, from about 20 degrees to about 70 degrees, at least greater than 20 degrees, at least smaller than 60 degrees, and about 30 degrees.

Further the angle may be selected such that it balances the forces between the peel forces associated with unrolling the roll and the weight of the roll forcing it down against the ribs. Thus the wipe can be unrolled without having excessive movement of the roll within the cartridge, which in turn overcomes the tendency of the roll to translate toward the gap and bind or jam the dispenser. Additionally, the selection of the angle may play a role in reducing the drying of the wet wipe. As the angle 72 is increased the difference between the height of the top of the roll and the tail is decreased, thus decreasing any siphoning driving force.

FIGS. 38–40 illustrate dispensers that have a rounded member 95 or rounded ridges 96. These components are shown as being part of or attached to the wiper blade assembly 24 and adjacent the wiper blade 74. These components prevent or reduce the tendency of the roll from binding in the gap as the size of the roll decreases.

FIGS. 25–30 show an example of a wiper assembly. In this example the wiper comprises a chassis 73, and a wiper blade 74 (74*a* shows sections of blade engaging and protruding through the chassis) that has fingers 75. In this example the fingers are designed to cooperate with the lowered surfaces of the guides 26 in the dispenser. In this example the blade is made of SANTOPRENE® and the chassis is made of polypropylene. A further embodiment of this type of wiper assembly is shown in FIGS. 33–37. This embodiment contains raised or thicker areas 97 of the wiper blade. These raised areas cooperate with the guides 26 on the tray.

FIGS. 31–32 show an example of a wiper blade. In this example the wiper blade is formed of a single piece (see FIG. 31) of material that is folded over to form the wiper blade (see FIG. 32). The wiper blade has raised portions 76 that reduce the amount of surface area of the wiper blade that contacts the sheet and raised areas 77 and lowered areas 78 that cooperate with the raised and lowered areas of the guides.

Wiper blades may be made out of any flexible material, such as thermoplastic elastomers, foam, sponge, plastic, or rubber having a shore A durometer hardness value ranging about 0 to 80, from about 15 to about 70 and from about 30 to about 60. It is further desirable that the wiper blades be made from a material that will form a good moisture and contamination barrier. Examples of desirable types of material are SANTOPRENE®, KRATON®, silicone, or styrene-ethylene/butylene-styrene (SEBS). The wiper blade material has a Gurley stiffness value (ASTM D 6125–97) between about 100 mg to 8000 mg, between about 200 mg to 6000 mg, and between about 400 mg to 3000 mg. The force applied to the wipe by the wiper blade when pulling the wipe from the dispenser should not be greater than the tensile strength of the wipe that is not perforated and not greater than the perforation tensile strength of a perforate wipe. Antibacterial agents may be added to the materials that makes up the wiper assembly.

The wiper blade is designed to function with the guides and the tray and to a limited extent the lip of the cartridge. Depending on the placement of the wiper, it could have greater or lesser interaction with these components of the dispensing system. The gap between the end of the wiper blade and the tray may be varied depending upon the thickness of the wet wipes and how much drag is need for the dispensing system to function as desired. The wiper blade can help to hold the tail of the wipe in place and thus keep the tail from falling back through the gap and into the cartridge. The force applied to the wipe by the wiper when pulling the wipe from the dispenser should not be greater than the tensile strength of the wipe in the non-perforated region and not greater than the perforation tensile strength of a perforated wipe. If the wipes are made such that they are dry in storage and become wet during use, the blade may be configured to exert pressure on the wipe. In this case, the dispensing of a sheet or sheets causes sufficient shear to be applied to the wipe to permit the moisture to be released. For example, this force or shear may be sufficient to cause microcapsules of fluid to burst or may be sufficient to rupture a protective emulsion which contains the fluid.

The dispenser has an opening that holds a cartridge, which contains the wet wipes. These cartridges are sealed and may be grouped in packages of multiple cartridges. Thus, a package of cartridges may be provided to a user. The user may then select and open one of the cartridges, put it in the dispenser, and use the wipes as needed. When the wipes are used up, the user may simply discard the old cartridge and replace it with a new one. This system enables the user to conveniently obtain and keep several cartridges of wipes on hand and then use the wipes as needed. By using sealed cartridges to refill the dispenser the user is using a new and fresh product each time and a product that is in contact with fresh surfaces.

We claim:

1. A dispensing system for wipes comprising:

a dispenser, the dispenser comprising a top: and a mounting bracket connected to the dispenser, the mounting bracket comprising arms, protrusions on the arms, and tabs at the end of the arms;

wherein, when the dispenser and mounting bracket are removably connected to a toilet tissue holder, the toilet tissue holder comprising posts and a horizontal axis defined by the posts, the dispenser and bracket are mounted between the posts of the toilet tissue holder by engagement of the protrusions with the posts such that the distance between the horizontal axis and the top of the dispenser is less than 5 inches.

2. The dispensing system of claim 1, wherein the dispenser further comprises sleeves;

wherein the tabs and sleeves mate together to connect the mounting bracket and the dispenser.

3. The dispensing system of claim 1, wherein the dispenser further comprises cavities and bracket guides;

wherein the tabs, cavities, and bracket guides mate together to connect the mounting bracket and the dispenser.

4. The dispensing system of claim 1, wherein the mounting bracket further comprises a back piece; the back piece connecting the arms, and the back piece further comprising a shim.

5. The dispensing system of claim 4, wherein the toilet tissue holder further comprises a rear periphery; and wherein the shim contacts the rear periphery when the dispenser is mounted.

6. The dispensing system of claim 1, wherein the distance between the horizontal axis and the top of the dispenser is less than 4 inches.

7. The dispensing system of claim 1, wherein the distance between the horizontal axis and the top of the dispenser is less than 3 inches.

8. The dispensing system of claim 1, wherein the distance between the horizontal axis and the top of the dispenser is less than 2 inches.

9. A dispensing system for wipes comprising:

a dispenser; and a mounting bracket attached to the dispenser, the mounting bracket comprising arms, the arms comprising protrusions; and the mounting bracket comprising a back piece, the back piece connecting the arms, and the back piece comprising a shim made of a compression resilient material;

wherein, when the mounting bracket is removably mounted to a toilet tissue holder comprising posts and a rear periphery, the protrusions engage the posts and the shim contacts the rear periphery.

10. The dispensing system of claim 9, wherein the dispenser mounted to a toilet tissue holder does not substantially move over a period of 10 minutes when subjected to a force of at least 500 g.

11. The dispensing system of claim 9, wherein the shim is made of foam.

12. The dispensing system of claim 9, wherein the shim is made of a thermoplastic elastomer.

13. The dispensing system of claim 9, wherein the shim comprises a spring.

14. A dispensing system for wipes comprising:

a dispenser, the dispenser comprising a means for dispensing wet wipes and a means for receiving a bracket; and a mounting bracket, the mounting bracket comprising a means for engaging a toilet tissue holder comprising posts and a rear periphery, a means for connecting to the dispenser, and a compressible means for contacting the rear periphery;

wherein the receiving means, connecting means, engaging means, and contacting means coordinate to secure the dispenser to the toilet tissue holder.

15. The dispensing system of claim 14, wherein the dispensing means maintains at least 95% of the moisture of wet wipes for a 14 day period at 73° F. and 50% relative humidity.

16. The dispensing system of claim 14, wherein the receiving means and the connecting means coordinate to attach the dispenser and the mounting bracket.

17. The dispensing system of claim 14, wherein the dispenser secured to a toilet tissue holder does not substantially move over a period of 10 minutes when subjected to a force of at least 500 g.

18. A dispensing system for wipes comprising;

a dispenser; the dispenser comprising a housing, the housing comprising sleeves; and a mounting bracket, the mounting bracket comprising a back piece and arms;

the arms comprising a front, a rear, and an exterior;

the arms comprising tabs at the front, and protrusions on the exterior;

the back piece connecting the arms at the rear of the arms to form an interior;

the back piece comprising a shim on the exterior;

the tabs mated with the sleeves; and the dispenser positioned adjacent the interior of the mounting bracket;

wherein the protrusions and the shim together engage a toilet tissue holder to secure the dispenser and mounting bracket to the toilet tissue holder.

19. A dispenser for wipes comprising:

a housing;

a cover, the cover pivotally connected to the housing;

arms, the arms connected to the housing, the arms comprising protrusions; and a back piece, the back piece connecting the arms, the back piece comprising a compressible shim;

wherein, when the dispenser is mounted to a toilet tissue holder comprising posts and a rear periphery, the protrusions engage the posts and the compressible shim contacts the rear periphery.

20. A method for dispensing wipes comprising:

providing a dispenser;

the dispenser comprising a housing and a mounting bracket connected to the housing; and the mounting bracket comprising arms, protrusions on the arms, and tabs at the end of the arms;

engaging the protrusions with the posts of a toilet tissue holder;

placing wipes in the dispenser; and dispensing the wipes.

21. The method of claim 20, wherein the bracket further comprises a back piece, the back piece connecting the arms, and the back piece comprising a shim.

22. The method of claim 21, further comprising compressing the shim against the rear periphery of a toilet tissue holder.

23. A method for dispensing wipes comprising:

providing a bracket;

the bracket comprising a back piece having a shim;

the bracket comprising arms connected to the back piece, the arms comprising protrusions and tabs;

contacting the shim against the rear periphery of a toilet tissue holder;

engaging the protrusions with the posts of a toilet tissue holder;

providing a dispenser, the dispenser comprising sleeves;

attaching the dispenser to the bracket by mating the sleeves and the tabs;

placing wipes in the dispenser; and dispensing the wipes.

* * * * *